US012344961B2

(12) United States Patent
Greiner et al.

(10) Patent No.: US 12,344,961 B2
(45) Date of Patent: Jul. 1, 2025

(54) METHOD OF PREPARING POLY (ACRYLONITRILE) FIBERS AND POLY(ACRYLONITRILE) FIBERS OBTAINABLE THEREWITH

(71) Applicant: Universität Bayreuth, Bayreuth (DE)

(72) Inventors: Andreas Greiner, Bayreuth (DE); Seema Agarwal, Marburg (DE); Xiaojian Liao, Bayreuth (DE)

(73) Assignee: Universität Bayreuth, Bayreuth (DE)

( * ) Notice: Subject to any disclaimer, the term of this patent is extended or adjusted under 35 U.S.C. 154(b) by 721 days.

(21) Appl. No.: 17/636,008

(22) PCT Filed: Aug. 19, 2020

(86) PCT No.: PCT/EP2020/073204
§ 371 (c)(1),
(2) Date: Feb. 16, 2022

(87) PCT Pub. No.: WO2021/037634
PCT Pub. Date: Mar. 4, 2021

(65) Prior Publication Data

US 2022/0282403 A1 Sep. 8, 2022

(30) Foreign Application Priority Data

Aug. 23, 2019 (EP) ..... 19193265

(51) Int. Cl.

| | |
|---|---|
| ***D01F 6/18*** | (2006.01) |
| ***D01D 5/00*** | (2006.01) |
| ***D01F 1/10*** | (2006.01) |

(52) U.S. Cl.
CPC ..... *D01F 6/18* (2013.01); *D01D 5/003* (2013.01); *D01F 1/10* (2013.01); *D10B 2321/10* (2013.01)

(58) Field of Classification Search
CPC .... D01F 6/18; D01F 1/10; D01F 6/54; D01D 5/003; D10B 2321/10
See application file for complete search history.

(56) References Cited

U.S. PATENT DOCUMENTS 9,771,669 B2 * 9/2017 Kumar ..... H05B 3/14
2014/0277572 A1 9/2014 Martin et al.
(Continued)

FOREIGN PATENT DOCUMENTS

CN 105088378 A 11/2015
CN 105839202 A 8/2016

OTHER PUBLICATIONS

Baker et al., "Mechanical and Thermal Properties of Acrylic Fibers Crosslinked with Disulfonyl Azides", Journal of Applied Polymer Science, Feb. 28, 2002, pp. 1309-1319, vol. 84, No. 7, XP055652399, Wiley Periodicals Inc.

(Continued)

*Primary Examiner* — Catherine S Branch
*Assistant Examiner* — Olga Lucia Donahue
(74) *Attorney, Agent, or Firm* — Foley & Lardner LLP

(57) ABSTRACT

The present invention relates to a method of preparing poly(acrylonitrile) fibers comprising: (i) providing a solution of poly(acrylonitrile) and a polyazide compound; and (ii) electrospinning the solution of poly(acrylonitrile) and a polyazide compound to provide fibers. The poly(acrylonitrile) fibers which are obtainable by the method are also claimed.

11 Claims, 14 Drawing Sheets

(56) References Cited

U.S. PATENT DOCUMENTS

2018/0215882 A1 8/2018 Viel et al.
2019/0002309 A1 1/2019 Cwiertny et al.

OTHER PUBLICATIONS

Baker et al., "Production of Cross-Linked PET Fibrous Substrates via Electrospinning", In: "Polymeric Nanofibers", Feb. 23, 2006, pp. 173-187, American Chemical Society. Washington, DC, XP055652420.
Extended European Search Report issued in corresponding EP Application No. 19193265.6 on Jan. 8, 2020.
International Search Report & Written Opinion of the International Searching Authority issued in International Application No. PCT/EP2020/073204, mailed Dec. 21, 2020.
Xie et al., "Continuous polyacrylonitrile nanofiber yarns: preparation and dry-drawing treatment for carbon nanofiber production", The Journal of The Royal Society of Chemistry, Jan. 15, 2015, pp. 15147-15153, vol. 5, No. 20, XP055652374.
Agarwal et al., "Functional materials by electrospinning of polymers", Progress in Polymer Science, Feb. 6, 2013, pp. 963-991, vol. 38, 2013 Elsevier Ltd.
Author Unknown, "Kevlar® Aramid Fiber, Technical Guide", 2017, DuPont, 24 pages.
Baniasadi et al., "High Performance Coils and Yarns of Polymeric Piezoelectric Nanofibers", ACS Appl Mater Interfaces 7, 2015, pp. 1-18.
Citra et al., "Molecular Orientation of High-Density Polyethylene Fibers Characterized by Polarized Raman Spectroscopy", Macromolecules, 1995, pp. 4007-4012, vol. 28, No. 11, 1995 American Chemical Society.
Demko et al., "A Click Chemistry Approach to Tetrazoles by Huisgen 1,3-Dipolar Cycloaddition: Synthesis of 5-Acyltetrazoles from Azides and Acyl Cyanides",. Angew. Chem., 2002, pp. 2217-2220, vol. 114, No. 12, Wiley VCH Verlag GmbH, Weinheim, Germany.
Dersch et al., "Electrospun Nanofibers: Internal Structure and Intrinsic Orientation", Journal of Polymer Science: Part A: Polymer Chemistry, 2004, pp. 545-553, vol. 41, 2003 Wiley Periodicals, Inc.
Dursun et al., "Recent developments in advanced aircraft aluminium alloys", Materials and Design, 2014, pp. 862-871, vol. 56, 2013 Elsevier Ltd.
Fratzl et al., "Nature's hierarchical materials", Progress in Materials Science, 2007, pp. 1263-1334, vol. 52, 2007 Elsevier Ltd.
Jin et al., "Mechanism of silk processing in insects and spiders", Nature, Aug. 28, 2003, pp. 1057-1061, vol. 424, 2003 Nature Publishing Group.
Kim et al., "Brittle intermetallic compound makes ultrastrong low-density steel with large ductility", Nature, Feb. 2015, pp. 1-13, vol. 518.
Lewis, "Spider Silk: Ancient Ideas for New Biomaterials", Chemical Reviews, pp. 3762-3774, 2006, vol. 106, 2006 American Chemical Society.
Li et al., "Electrospinning of Nanofibers: Reinventing the Wheel?" Advanced Materials, Jul. 19, 2004, pp. 1151-1170, vol. 16, No. 15, 2004 Wiley-VCH Verlag Gmbh & Co. KGaA, Weinheim.
Madsen et al., "Variability in the mechanical properties of spider silks on three levels: interspecific, intraspecific and intraindividual", International Journal of Biological Macromolecules, 1999, pp. 301-306, vol. 24, 1999 Elsevier Science B.V.
Miaudet et al., "Hot-Drawing of Single and Multiwall Carbon Nanotube Fibers for High Toughness and Alignment", Nano Letters, 2005, pp. 2212-2215, vol. 5, No. 11, 2005 American Chemical Society.
Motta et al., "High Performance Fibres from 'Dog Bone' Carbon Nanotubes", Advanced Materials, 2007, pp. 3721-3726, vol. 19, 2007 Wiley-VCH Verlag Gmbh & Co. KGaA, Weinheim.
O'Connor et al., "High-Strength, High-Toughness Composite Fibers by Swelling Kevlar in Nanotube Suspensions", Small, 2009, pp. 466-469, vol. 6, No. 4, 2009 Wiley-VCH Verlag GmbH & Co. KGaA, Weinheim.
Ou et al., "Strain Rate and Temperature Effects on the Dynamic Tensile Behaviors of Basalt Fiber Bundles and Reinforced Polymer Composite", Journal of Materials in Civil Engineering, Oct. 2016, pp. 1-10, vol. 28, Issue 10, 04016101.
Ouyang et al., "Effect of Jet Swell and Jet Stretch on the Structure of Wet-Spun Polyacrylonitrile Fiber", Journal of Macromolecular Science, Part B: Physics, 2011, pp. 2417-2427, vol. 50, Taylor & Francis Group, LLC.
Papkov et al., "Simultaneously Strong and Tough Ultrafine Continuous Nanofibers", ACS Nano. 2013, pp. 3324-3331, vol. 7.
Persano et al., "Industrial Upscaling of Electrospinning and Applications of Polymer Nanofibers: A Review", Macromolecular Materials and Engineering, 2013, pp. 1-17, vol. 298, 2013 Wiley-VCH Verlag Gmbh & Co., KGaA, Weinheim.
Shen et al., Accepted Manuscript of "Crystalline and pseudo-crystalline phases of polyacrylonitrile from molecular dynamics: implications for carbon fiber precursors", Polymer, Sep. 12, 2018, pp. 1-33.
Shin et al., "Synergistic toughening of composite fibres by self-alignment of reduced graphene oxide and carbon nanotubes", Nature Communications, Jan. 31, 2012, pp. 1-8, vol. 3, Article No. 650, 2012 Macmillan Publishers Limited.
Shuakat et al., "Recent Developments in Electrospinning of Nanofiber Yarns", Journal of Nanoscience and Nanotechnology, 2014, pp. 1389-1408, vol. 14, No. 2, American Scientific Publishers, USA.
Su et al., "Dynamic Mechanics", Nature Materials, Oct. 2016, pp. 1054-1055, vol. 15, 2016 Macmillan Publishers Limited, part of Springer Nature.
Sui et al., "Mechanical properties of electrospun PMMA micro-yarns: Effects of NaCl mediation and yarn twist", Polymer, 2012, pp. 5037-5044, vol. 53, 2012 Elsevier Ltd.
Vollrath et al., "Liquid crystalline spinning of spider silk", Nature, Mar. 29, 2001, pp. 541-548, vol. 410, 2001 Macmillan Magazines Ltd.
Vollrath et al., "The Effect of Spinning Conditions on the Mechanics of a Spider's Dragline Silk", Proceedings: Biological Sciences, Nov. 22, 2001, pp. 2339-2346, vol. 268, No. 1483, 2001 The Royal Society.
Wang et al., "Super-Strong, Super-Stiff Macrofibers with Aligned, Long Bacterial Cellulose Nanofibers", Advanced Materials, 2017, pp. 1-8, 2017 Wiley-VCH Verlag Gmbh & Co. KGaA, Weinheim.
Wegst et al., "Bioinspired structural materials", Review Article, Nature Materials, Jan. 2015, pp. 23-36, vol. 13, 2014 Macmillan Publishers Limited.
Wu et al., "Identifying the Crystalline Orientation of Black Phosphorus Using Angle-Resolved Polarized Raman Spectroscopy", Angewandte Chemie, 2015, pp. 1-5, vol. 54, 2015 Wiley-VCH Verlag Gmbh & Co. KGaA, Weinheim.
Xiang et al., Accepted Manuscript for "In-situ Twisting for Stabilizing and Toughing Conductive Graphene Yarns", Royal Society of Chemistry, 2017, pp. 1-6, vol. 9, The Royal Society of Chemistry.
Xie et al., Accepted Manuscript of "Continuous Polyacrylonitrile Nanofiber Yarns: Preparation and Dry-drawing Treatment for Carbon Nanofiber Production", RSC Advances, 2015, pp. 1-7, vol. 5, The Royal Society of Chemistry 2013.
Xu et al., "Ultrastrong Fibers Assembled from Giant Graphene Oxide Sheets", Advanced Materials, 2013, pp. 188-193, vol. 25, Wiley-VCH Verlag Gmbh & Co. KGaA, Weinheim.
Yusof et al., "Post spinning and Pyrolysis processes of polyacrylonitrile (PAN)-based carbon fiber and activated carbon fiber: A review", Journal of Analytical and Applied Pyrolysis, 2012, pp. 1-13, vol. 93, 2011 Elsevier B.V.
Zhang et al., "Multifunctional Carbon Nanotube Yarns by Downsizing an Ancient Technology", Science, pp. 1358-1361, Nov. 19, 2004, vol. 306.
Zhang et al., "Nanoparticles meet electrospinning: recent advances and future prospects", Chemical Society Reviews, 2014, pp. 4423-4448, vol. 43, The Royal Society of Chemistry 2014.

(56) References Cited

OTHER PUBLICATIONS

Zhu et al., "Experimental and numerical study of multi-scale tensile behaviors of Kevlar® 49 fabric", Journal of Composite Materials, 2017, pp. 2449-2465, vol. 51, No. 17.
Zhu et al., "Experimental Study of Dynamic Behavior of Kevlar 49 Single Yarn", Proceedings of the SEM Annual Conference, Jun. 7-10, 2010, pp. 147-152, Indianapolis, Indiana USA, The Society for Experimental Mechanics, Inc. 2011.

* cited by examiner

| Materials | Density g/cm$^3$ | Strength GPa | Specific strength GPa/g·cm$^3$ | E-modulus GPa | Specific E-modulus GPa/g·cm$^3$ | Toughness J/g | Elongation at break % | Ref. |
|---|---|---|---|---|---|---|---|---|
| Spider silk | 1.3 | 0.94-1.4 | 0.72-1.05 | 7.9 | 6.08 | 112.2-200 | 39 | [1-3] |
| CNT yarn | 0.8 | 0.46 | 0.575 | - | - | 11-20 | 3-13 | [4] |
| Hot-drawn CNTs/PVA | 1.33 | 1.6 | 1.2 | 40 | 30.08 | 40-870 | 11 | [5] |
| CVD-grown CNT yarn | 1.0 | 2.2 | 2.2 | 160 | 160 | 46-60 | 3 | [6] |
| Reduced graphene oxide/CNTs/PVA | 2.1 | 0.58 | 0.276 | 3.6 | 1.71 | 481-970 | 360 | [7] |
| Graphene yarn | 1.8 | 0.502 | 0.28 | 11.2 | 6.22 | 11.5-23.8 | 6.7 | [8] |
| Graphene yarn | 0.8 | 0.217 | 0.27 | 4.7 | 5.88 | 7.6-57.9 | 40 | [9] |
| Kevlar 81 | 1.44 | 3.6 | 2.5 | 90 | 62.5 | 33 | 5 | [1] |
| Kevlar 29 | 1.44 | 2.92 | 2.03 | 70.5 | 49.0 | 33 | 3.6 | [10] |
| Kevlar 49 | 1.44 | 3.0 | 2.08 | 112.4 | 78.10 | 33 | 2.4 | [10] |
| Kevlar/CNTs | 1.5 | 5.9 | 3.9 | 207 | 138 | 63-99 | 5.4 | [11] |
| Nomex | 1.38 | 0.6 | 0.43 | 17 | 12.3 | 44 | 22 | [12] |
| E-glass | 2.57 | 3.45 | 1.34 | 72 | 28.01 | 22 | 4.8 | [12] |
| S-glass | 2.46 | 4.89 | 1.99 | 88 | 35.77 | 27 | 5.7 | [12] |
| Light steel | 6.82 | 1.548 | 0.23 | - | - | 43.7-58 | 20-30 | [13] |
| Aluminium alloys | 2.77 | 0.47 | 0.17 | - | - | 25 | 10 | [14] |
| Tool steel | 7.8 | 1.53 | 0.20 | - | - | 14-50 | 4.8 | [12,13] |
| Basalt yarn | 2.8 | 1.452 | 0.52 | 83 | 29.64 | 53.6 | 3.5 | [15] |
| Cellulose nanofibre yarn | 1.38 | 0.83 | 0.6 | 65.7 | 47.61 | -- | 2.5 | [16] |
| Nylon 6,6 | 1.14 | 1.05 | 0.92 | | | 80.5 | | [12] |
| Polyester | 1.38 | 1.16 | 0.84 | 2.5 | 1.18 | 50 | | [12] |
| PMMA yarn | 1.18 | 0.08 | 0.068 | 1.8 | 1.52 | 0.4-16.9 | 29 | [17] |
| PVDF yarn | 1.87 | 0.202 | 0.108 | 0.28 | 0.15 | 34-98.6 | 154 | [18] |
| **Yarns of Example 1** | **1.18** | **1.24** | **1.05** | **13.5** | **11.44** | **118-166** | **28.2** | |

Figure 14

METHOD OF PREPARING POLY (ACRYLONITRILE) FIBERS AND POLY(ACRYLONITRILE) FIBERS OBTAINABLE THEREWITH

CROSS-REFERENCE TO RELATED APPLICATIONS

The present application is a National Stage entry of International Patent Application No. PCT/EP2020/073204, filed on Aug. 19, 2020, which claims priority to European Patent Application No. 19193265.6, filed on Aug. 23, 2019. The contents of these applications are hereby incorporated by reference in their entireties.

FIELD OF THE INVENTION

The present invention relates to a method of preparing poly(acrylonitrile) fibers and poly(acrylonitrile) fibers obtainable therewith.

BACKGROUND OF THE INVENTION

The drag-line silk that spiders use to frame their webs has high toughness and high specific strength (NPL-1 to NPL-3). Key factors behind these desirable mechanical properties are the hierarchical structure and dynamical rearrangement of crystallites in response to the applied stress (NPL-4). Fibers and yarns of existing commodity polymers and composites lack the toughness and strength of drag-line spider silk. Polymer nanofibers displayed until now highest toughness in combination with high strength (NPL-5). However, they do not match the values for drag-line spider silk. Considering the basis of the silk's hierarchical structure properties (NPL-6), the requirement of small diameters (NPL-5) and the power of hierarchical materials design (NPL-7), there has been a desire for poly(acrylonitrile) (PAN) fibers with an improved toughness and tensile strength (e.g., 137±21.4 J/g and a tensile strength of 1236±40.4 MPa).

Electrospinning is a highly useful technique for the fabrication of polymer fiber nonwovens (NPL-8 to NPL-10; NPL-20). The fibers are formed by the action of an electric field on a polymer solution or melt at an electrode. The fibers are collected continuously as a nonwoven web at the counter electrode. The fibers typically have diameters ranging from a few nanometers up to several micrometers depending on the nature of the polymer and the electrospinning parameters. In special electrospinning set-ups, polymer yarns with diameters of several ten micrometers are formed which consist of numerous fibers (NPL-11). Continuous electrospinning of polymer yarn is possible by a two-electrode set-up (NPL-12), which yields strands of several 100 meters length consisting of numerous non-oriented macrofibers.

PL-1 refers to a method for preparing poly(acrylonitrile) nanofibers through an electrostatic spinning technology.

PL-2 describes a method for controlling the diameter and the structure of electrospun poly(acrylonitrile) fibers.

Poly(acrylonitrile) nanofiber yarns have been used, among others, in the preparation of carbon nanofibers (NPL-13).

In view of the above, it is an object of the present invention to provide poly(acrylonitrile) (PAN) fibers with an improved toughness and tensile strength.

CITED LITERATURE

PL-1: CN 105088378 (A)

PL-2: CN 105839202 (A)

NPL-1: Vollrath, F., Knight D. P., Liquid crystalline spinning of spider silk. *Nature* 410, 541-548 (2001).

NPL-2: Jin, H.-J., Kaplan, D. L., Mechanism of silk processing in insects and spiders. *Nature* 424, 1057-1061 (2003).

NPL-3: Lewis, R. V., Spider Silk: Ancient ideas for new biomaterials. *Chem. Rev.* 106, 3762-3774 (2006).

NPL-4: Su, I., Buehler, M. J. Dynamic mechanics, *Nature Mater.* 15, 1055 (2015).

NPL-5: Papkov, D., Zou, Y., Andalib, M. N., Goponenko, A., Cheng, S. Z. D., Dzenis, Y., Simultaneously strong and tough ultrafine continuous nanofibers. *ACS Nano.* 7, 3324-3331 (2013).

NPL-6: Fratzl, P., Weinkamer, R., Nature's hierarchical materials. *Progr. Mater. Sci.* 52 1263-1334, (2007).

NPL-7: Wegst, U. G. K., Bai, H., Saiz, E., Tomsia, A. P. & Ritchie, R. O. Bioinspired structural materials. *Nat. Mater.* 14, 23-36 (2015).

NPL-8: Li, D., Xia, Y., Electrospinning of nanofibers: Reinventing the wheel? *Adv. Mater.* 16, 1151-1170 (2004)

NPL-9: Agarwal, S., Greiner, A., Wendorff, J. H., Functional materials by electrospinning of polymers. *Progr. Polym. Sci.* 38, 963— 991 (2013).

NPL-10: Zhang, C.-L., Yu, S. H., Nanoparticles meet electrospinning: recent advances and future prospects. *Chem. Soc. Rev.* 43, 4423-4448 (2014).

NPL-11: Shuakat, M. N., Lin, T., Recent developments in electrospinning of nanofiber yarns. *J. Nanosci. Nanotechn.* 14, 1389-1408 (2014).

NPL-12: Xie, Z., Niu, H., Lin, T., Continuous polyacrylonitrile nanofiber yarns: Preparation and dry-drawing treatment for carbon nanofiber production. *RSC Advances* 5, 15147-15153 (2015)

NPL-13: Yusofa, N., Ismail, A. F., Post spinning and pyrolysis processes of polyacrylonitrile (PAN)-based carbon fiber and activated carbon fiber: A review. *J. Anal. Appl. Pyrol.* 93, 1-13, (2012).

NPL-14: Demko, Z. P., Sharpless, K. B., A click chemistry approach to tetrazoles by Huisgen 1,3-dipolar cycloaddition: Synthesis of 5-acyltetrazoles from azides and acyl cyanides. *Angew. Chem., Int. Ed.* 12, 2113-2116 (2002).

NPL-15: Shen T, Li C, Haley B, et al. Crystalline and pseudo-crystalline phases of polyacrylonitrile from molecular dynamics: Implications for carbon fiber precursors. *Polymer* 155, 13-26 (2018).

NPL-16: Madsen, B., Shao, Z. Z. & Vollrath, F. Variability in the mechanical properties of spider silks on three levels: interspecific, intraspecific and intraindividual. Int. *J. Biol. Macromol.* 24, 301-306 (1999).

NPL-17: Vollrath, F., Madsen, B. & Shao, Z. The effect of spinning conditions on the mechanics of a spider's dragline silk. *Proc.R.Soc.Lond.B.* 268, 2339-2346 (2001).

NPL-18: Zhu, D., Zhang, X., Ou, Y. & Huang, M. Experimental and numerical study of multi-scale tensile behaviors of Kevlar® 49 fabric. *J. Com. Mater.* 51, 2449-2465 (2016).

NPL-19: DuPont. Technical Guide for Kevlar® Aramid Fiber.

NPL-20: Persano, L., Camposeo, A., Tekmen, C., Pisignano, D., Industrial Upscaling of Electrospinning and Applications of Polymer Nanofibers: A Review. *Macromol. Mater. Eng.* 298, 504-520 (2013).

SUMMARY OF THE INVENTION

The present invention is summarized in the following items:

1. A method of preparing poly(acrylonitrile) fibers comprising:
   (i) providing a solution of poly(acrylonitrile) and a polyazide compound; and
   (ii) electrospinning the solution of poly(acrylonitrile) and a polyazide compound to provide fibers.
2. The method according to item 1, wherein the fibers obtained in step (ii) are collected in the form of a yarn.
3. The method according to item 2, wherein the yarn is stretched at a temperature which is above the glass transition temperature $T_g$ of the poly(acrylonitrile) and is below the oxidation temperature of the poly(acrylonitrile).
4. The method according to item 3, wherein the yarn is annealed.
5. The method according to item 4, wherein the yarn is annealed at temperature in the range of about 120° C. to about 140° C.
6. The method according to item 1, wherein the fibers obtained in step (ii) are collected in the form of a non-woven web.
7. A method of preparing a poly(acrylonitrile) yarn comprising:
   (i) providing a solution of poly(acrylonitrile) and a polyazide compound;
   (ii) electrospinning the solution of poly(acrylonitrile) and a polyazide compound to provide fibers in the form of a yarn;
   (iii) stretching the yarn obtained in step (ii); and
   (iv) annealing the stretched yarn.
8. The method according to any one of items 1 to 7, wherein the polyazide compound is selected from the group consisting of poly(ethylene glycol) bisazide, poly(propylene glycol) bisazide, polyurethane bisazide and combinations thereof.
9. Poly(acrylonitrile) fibers obtainable by the method according to any one of items 1 to 8.
10. The poly(acrylonitrile) fibers according to item 9 which are in the form of a nonwoven web or a yarn.
11. The poly(acrylonitrile) fibers according to item 10 which are in the form of a yarn.
12. A poly(acrylonitrile) yarn obtainable by the method according to item 7.

(a): Digital photograph of the continuous as-spun multifiber yarns.

(b): Scanning electron microscopy micrograph (SEM) of as-spun multifiber yarns (long axis).

(c): SEM of as-spun multifiber yarns (cross-section).

(d): Digital photograph of stretched multifiber yarns.

(e): SEM of stretched (stretch ratio 8 at 160° C.) and annealed (130° C. for 4 h) multifiber yarns (long axis).

(f): SEM of stretched (stretch ratio 8 at 160° C.) and annealed (130° C. for 4 h) multifiber yarns (cross-section).

The scale bar in the photographs of the as-spun multifiber yarns (a) and stretched multifiber yarns (d) is 20 mm.

Figure 13:
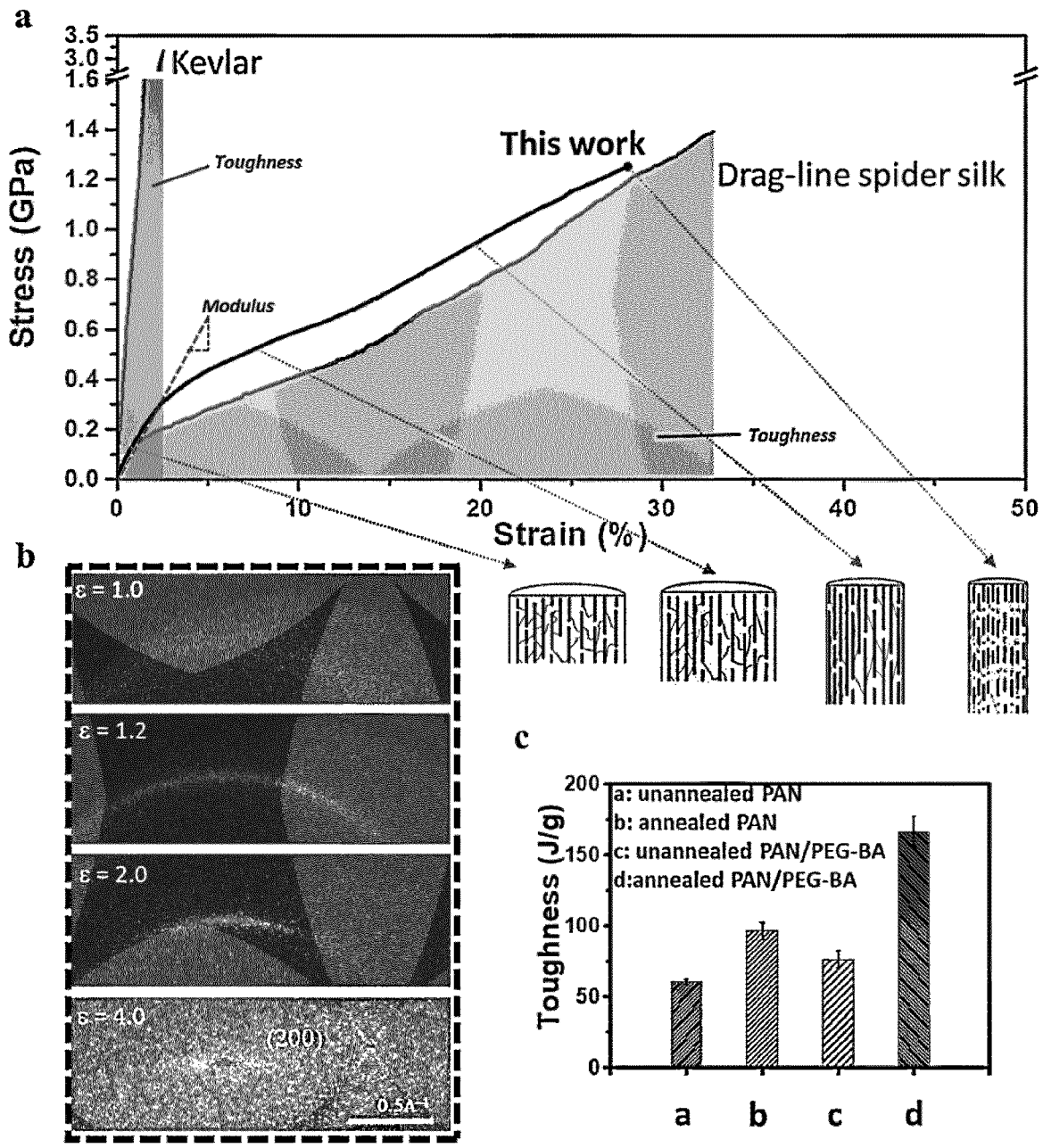

FIG. 13: Comparison of tensile strength and tensile toughness of stretched and annealed in comparison to yarns of other polymers.

(a) Comparison of stress-strain behavior and toughness of multifiber yarns (4 wt.-% PEG-BA, stretch ratio 8 at 160° C., annealed at 130° C. for 4 h) in comparison to drag-line spider silk and Kevlar (the silk and Kevlar data are taken from the NPL-1, NPL-16 to NPL-19) with a model for the stress/strain behavior of multifiber yarns in the lower panel. The thick straight lines represent poly(acrylonitrile) macromolecular chains, and the thin lines denote PEG-BA moieties.

(b) in-situ 2D-WAXS patterns recorded during stretching process of a single EFY at 160° C. With increasing extension, we observe the development of a sharp Debye-Scherrer ring, subsequently followed by the development of a sharp (200)-reflection indicating crystal formation and alignment with high orientational order.

(c) Comparison of the toughness of unannealed and annealed multifiber yarns with a stretch ratio of 8 at 160° C.

FIG. 14: Table 1.

DETAILED DESCRIPTION OF THE INVENTION

The present invention refers to a method of preparing poly(acrylonitrile) fibers comprising:

(i) providing a solution of poly(acrylonitrile) and a polyazide compound; and (ii) electrospinning the solution of poly(acrylonitrile) and a polyazide compound to provide fibers.

Step (i): Providing a Solution of Poly(acrylonitrile) and a Polyazide Compound

The poly(acrylonitrile) which is employed in the method of the present invention is not particularly limited and can be any homopolymer or copolymer which contains acrylonitrile units. Typically the poly(acrylonitrile) will be a homopolymer or a copolymer which has up to 15 mol-% (preferably up to 10 mol-%, more preferably up to 5 mol-%) monomers other than acrylonitrile. The comonomers are not limited as long as they do not interfere with the reaction with the polyazide compound. Typical examples thereof include $C_{1-6}$ alkyl (meth)acrylates. In one embodiment, the poly (acrylonitrile) is a homopolymer.

The molecular weight of the poly(acrylonitrile) is not limited. Typical molecular weights (number average molecular weight) are in the range of about 10,000 to about 9,000,000, preferably about 50,000 to about 500,000, more preferably about 80,000 to about 200,000.

The content of poly(acrylonitrile) in the solution can range from about 5 wt.-% to about 25 wt.-%, preferably about 5 to about 17 wt.-%, more preferably about 8 to about 17 wt.-%.

The polyazide compound can be any compound which has at least two azide moieties, such as diazide compounds, triazide compounds or compounds having four or more azide moieties. Typically, the compounds will have two to five, more typically two azide moieties. Examples of the polyazide compound include poly(ethylene glycol) bisazide, poly(propylene glycol) bisazide, polyurethane bisazide and combinations thereof, preferably poly(ethylene glycol) bisazide, poly(propylene glycol) bisazide, and combinations thereof, more preferably poly(ethylene glycol) bisazide.

The molecular weight (number average molecular weight) of the poly(ethylene glycol) and poly(propylene glycol) which are contained in the poly(ethylene glycol) bisazide and poly(propylene glycol) bisazide, respectively, is not limited but is typically in the range of about 200 to about 20,000, preferably about 1,000 to about 20,000.

The content of polyazide compound to the weight of poly(acrylonitrile) can range from about 0 wt % to about 10 wt.-%, preferably about 3 wt.-% to about 6 wt.-%.

The poly(acrylonitrile) and the polyazide are dissolved in a solvent to provide an electrospinning solution. The type of solvent is not particularly limited and any solvents which can dissolve the poly(acrylonitrile) and the polyazide can be used. Typical solvents include polar organic solvents such as amide solvents (e.g., dimethylformamide, dimethylacetamide, methyl-2-pyrrolidinone, and dimethylsulfoxide). Preferred solvents include dimethylformamide and dimethylacetamide as well as combinations thereof.

Low amounts of non-solvents with a low boiling point (e.g., acetone, tetrahydrofuran, ethanol, formic add, and acetic add as well as combinations thereof) can also be present in addition to the solvent. Preferred non-solvents with a low boiling point include acetone and tetrahydrofuran as well as combinations thereof. Within the present application, "non-solvent with a low boiling point" means that the non-solvents can not dissolve poly(acrylonitrile) and that the boiling point is in the range of about 30° C. to about 100° C.

The non-solvent with a low boiling point improves the production of the individual nanofibers in the yarns during the electrospinning process because the non-solvent with a low boiling point can increase the evaporation rate and result in dry individual nanofibers.

The amount of non-solvents to the weight of the solvents and non-solvents is not particularly limited as long as the combination of solvents and non-solvents is able to dissolve the poly(acrylonitrile) and the polyazide. The amount of non-solvents with a low boiling point can range from about 0 wt.-% to 20 wt.-%, preferably about 5 wt.-% to about 17 wt.-%, based on the combined weight of the solvents and non-solvents.

If necessary, dissolution can be facilitated by heating.

Step (ii): Electrospinning the Solution of Poly(acrylonitrile) and a Polyazide Compound to Provide Fibers The prepared solution of poly(acrylonitrile) and a polyazide compound is subjected to an electrospinning step to provide fibers.

Electrospinning is a well-known method for producing fibers by jetting a polymer solution in the presence of a high electric field. This technology has been used for forming poly(acrylonitrile) fibers (cf. among others PL-1, PL-2, NPL-12 and NPL-13). Any conventional electrospinning process which is suitable for preparing poly(acrylonitrile) fibers can be employed.

Figure 1:
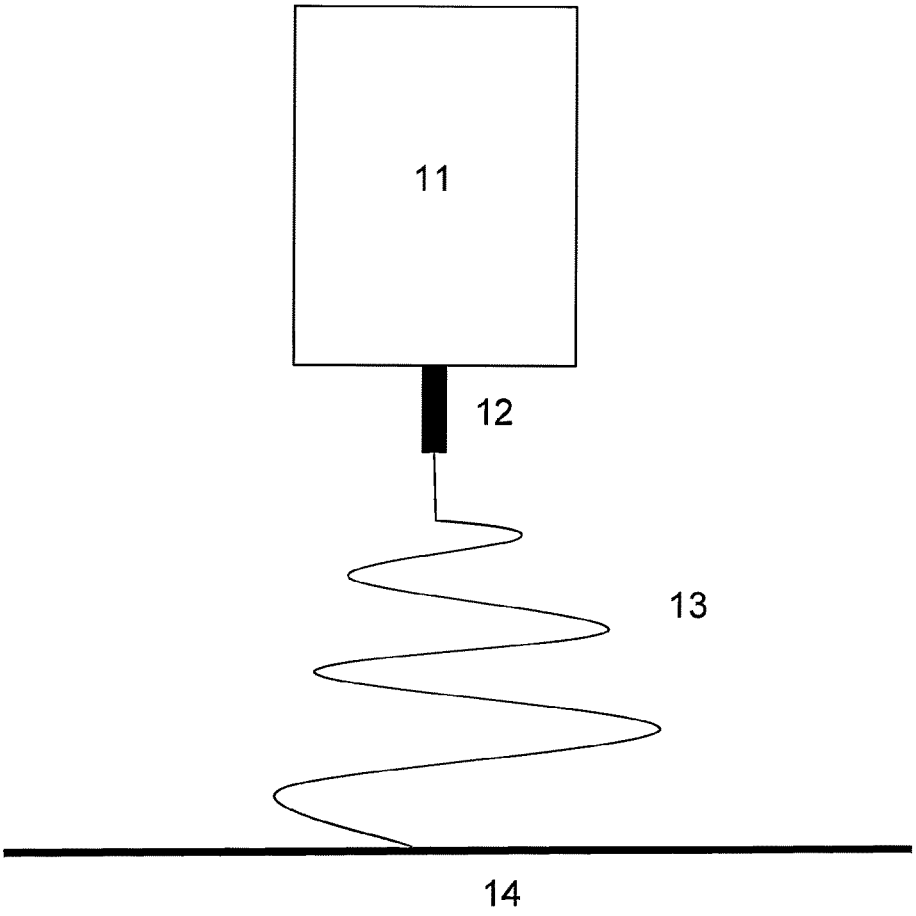
FIG. 1: Scheme illustrating the electrospinning method.

An scheme illustrating electrospinning is shown in FIG. 1. The polymer solution is provided in a container 11 which is provided with a narrow outlet (spinning tip) 12. A polymer solution is forced out of the container at a desired rate while a high voltage is applied to the narrow outlet 12 from a power supply. When the voltage is sufficiently high the electrostatic repulsion is higher than the surface tension and a stream of polymer solution 13 emits from the tip of the narrow outlet. Initially, a jet of charged solution is formed. The solvent evaporates during flight, forming a fiber. However, as the jet dries in flight, it experiences a whipping instability caused by electrostatic repulsion which results in significant thinning of the fiber. The fiber can be deposited on a grounded collector 14 as a nonwoven web of fibers. Alternatively, it is possible to use, e.g., a rotating collector (e.g., a cylinder or a funnel) as a grounded collector 14 in order to collect the fibers as a spool of fibers which can be used to provide a yarn.

Figure 2:
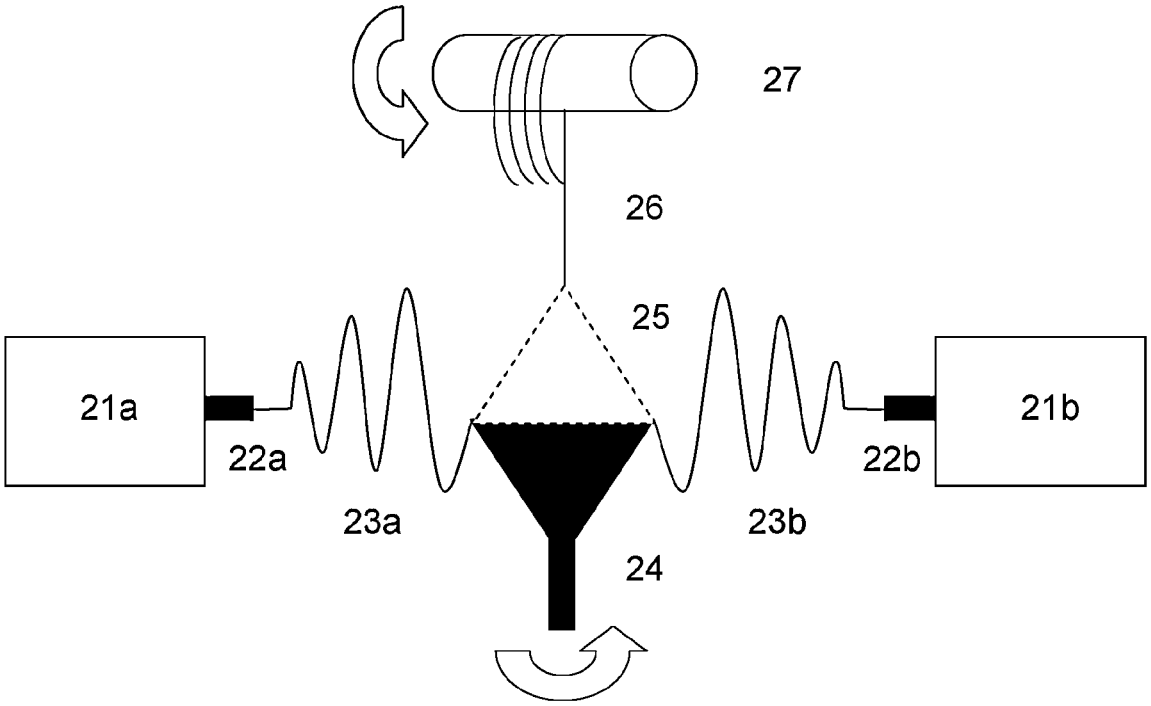
FIG. 2: Scheme illustrating an electrospinning apparatus for forming yarn.
Figure 3:
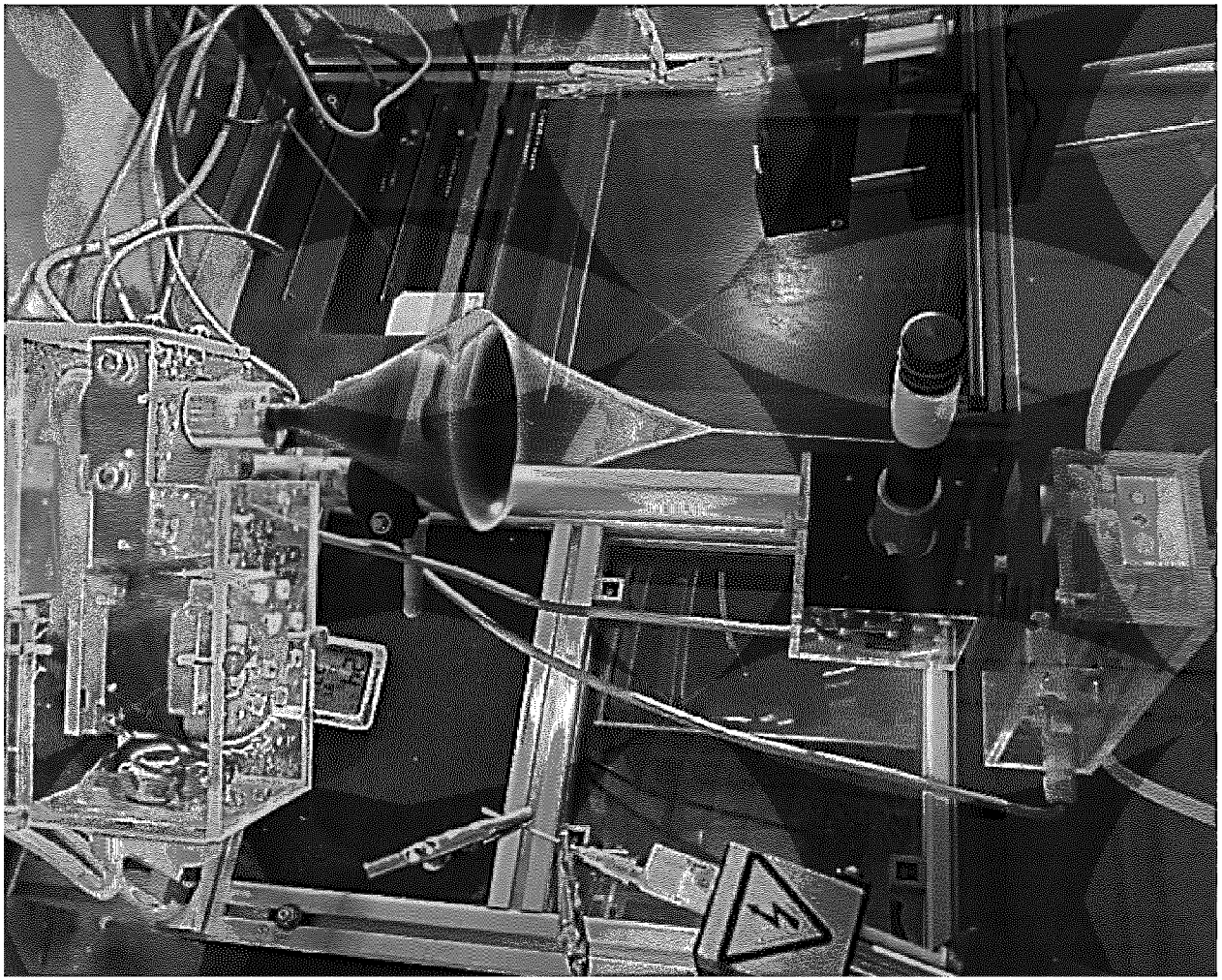
FIG. 3: Photograph of an apparatus for forming yarn that was employed in the examples.

A further apparatus for forming a yarn is shown in FIG. 2. This apparatus has two containers 21*a*, 21*b* which contain the polymer solution and each have a narrow outlet (spinning tip) 22*a*, 22*b*. The polymer solution is forced out of the containers 21*a*, 21*b* at a desired rate while a high voltage is applied to the narrow outlet 22*a*, 22*b* from a power supply. In the embodiment shown in FIG. 2, the narrow outlet 21*a* has a positive charge, while the narrow outlet 21*b* has a negative charge. When the voltage is sufficiently high the electrostatic repulsion is higher than the surface tension and a stream of polymer solution 23*a*, 23*b* emits from the tips of the narrow outlets 22*a*, 22*b*. The two negatively charged fibers fly to the rotating collector (e.g., a cylinder or (as shown in FIG. 2) a funnel) which is used as a grounded collector 24 forming a thin fiber cone 25. The fiber cone 25 dragged by a presuspended thread to a winder collector 26. A rotodynamic fiber cone 25 is formed above the rotating collector 24. Due to the rotation of the rotating collector 4, the fibers in the rotodynamic fiber cone 25 are pulled towards the winder collector 26 and simultaneously twisted to a yarn. The twisted yarn 26 is wound around the rotating winder collector 27.

The conditions of the electrospinning will depend on the specific solution chosen and the apparatus which is employed and can be suitably determined by a person skilled in the art.

The feed rate of the solution can, for instance, be in the range of about 0.2 mL/h to about 2 mL/h, preferably about 0.4 mL/h to about 1.0 mL/h. If more than one narrow outlet is present, then the above feed rate applies to each narrow outlet.

The spinning voltage is not limited and is typically in the range of about 8 kV to about 20 kV, preferably about 12 kV to about 16 kV. In the embodiment of FIG. 2, the spinning voltage of the narrow outlet 21*a* having a positive charge is typically in the range of about 8 kV to about 20 kV, preferably about 12 kV to about 16 kV, while the spinning voltage of the narrow outlet 21*b* having a negative charge is typically in the range of about −8 kV to about −20 kV, preferably about −12 kV to about −20 kV.

The distance from the end of the narrow outlet to the collector employed in the apparatus of FIG. 1 is usually from about 30 cm to about 50 cm, preferably about 35 cm to about 45 cm.

The distance from the end of the narrow outlet to the collector employed in the apparatus of FIG. 2 is usually from about 1 cm to about 6 cm, preferably about 2 cm to about 4 cm.

If a rotating collector 14 is employed in the apparatus of FIG. 1, the rotation speed can be chosen appropriately by a skilled person. Typical rotation speeds are about 50 rpm to about 2,000 rpm, preferably about 800 rpm to about 1,000 rpm.

In the embodiment of FIG. 2, the rotation speed of the rotating collector 24 can be chosen appropriately by a skilled person. Typical rotation speeds are about 500 rpm to about 5,000 rpm, preferably about 1,000 rpm to about 2,000 rpm.

The rotation speed of the winding collector 26 can be chosen appropriately by a skilled person. Typical rotation speeds are about 5 rpm to about 20 rpm, preferably about 10 rpm to about 15 rpm.

In the embodiment of FIG. 2, the diameter of the rotating collector 24 can be chosen appropriately by a skilled person. Typical diameter are about 50 mm to about 1000 mm, preferably about 70 mm to about 90 mm.

The diameter of the rotating collector 26 can be chosen appropriately by a skilled person. Typical diameters are about 10 mm to about 100 mm, preferably about 15 mm to about 20 mm.

The temperature at which the electrospinning step is conducted can range from about 25° C. to about 50° C., preferably about 30° C. to about 45° C.

The humidity at which the electrospinning step is conducted can range from about 5% to about 50%, preferably about 10% to about 15%.

The diameter of the fibers which are obtained after step (ii) will vary depending on the chosen conditions. They can, for instance, be in the range of about 50 nm to about 5,000 nm, preferably about 400 nm to about 2,000 nm.

If, e.g., a static collector or a moving belt are used as a collector 14 a nonwoven web of fibers is obtained which can be used as such.

If a rotating collector is used as a collector 14 or an apparatus shown in FIG. 2 is employed, a yarn comprising a plurality of fibers is formed. The number of fibers in the yarn is not particularly limited and can be chosen depending on the desired end use of the yarn. Possible values range from about 1,000 to about 90,000 fibers, more typically about 2,000 to about 5,000 fibers.

Step (iii): The Yarn Obtained in Step (ii) is Stretched

If desired, the yarn obtained step (ii) can be stretched to improve its mechanical properties. Any conventional apparatus for stretching filaments can be employed in step (iii).

Figure 4:
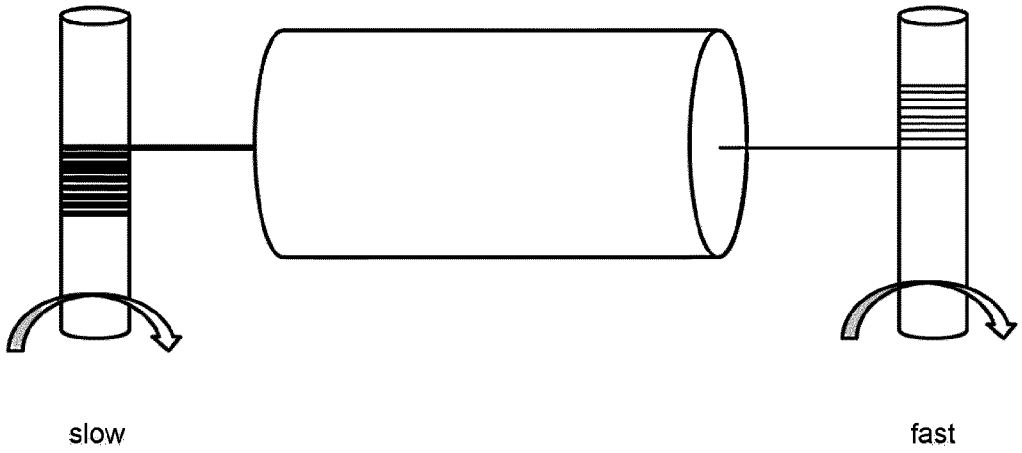
FIG. 4: Scheme illustrating an apparatus for stretching yarn that was employed in the examples.
Figure 5:
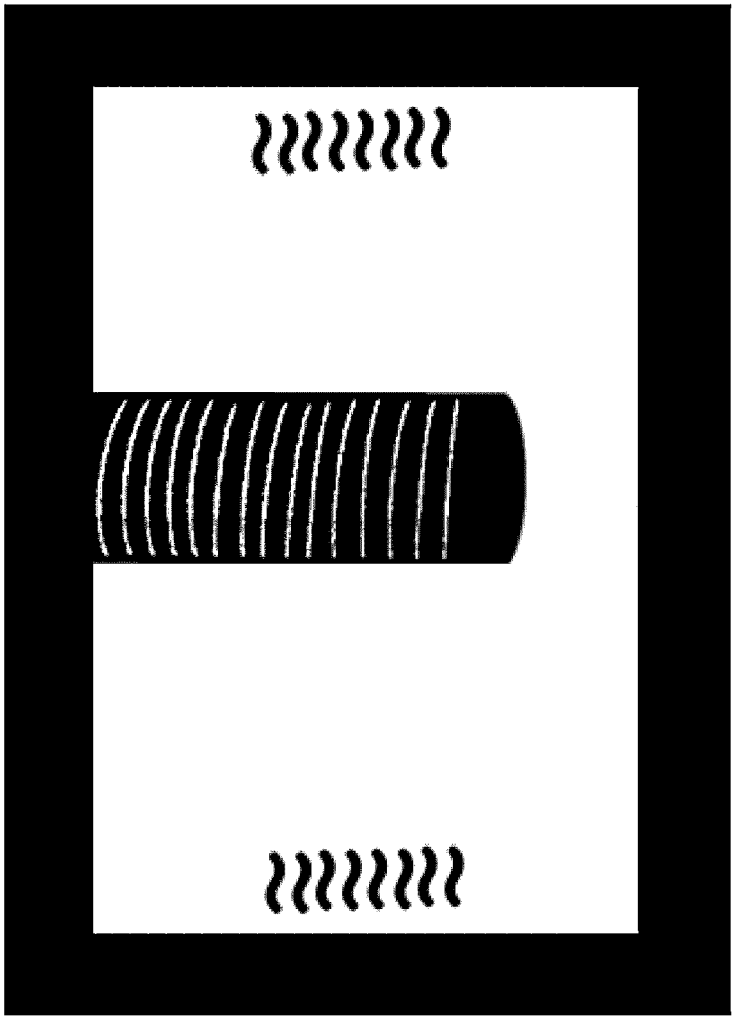
FIG. 5: Scheme illustrating an apparatus for annealing yarn that was employed in the examples.

One apparatus which was employed in the examples of the present application is illustrated in FIG. 4.

The stretching ratio (length of the yarn after stretching: length of the yarn before stretching) can be chosen appropriately by a skilled person and can be in the range of about 2 to about 20, preferably about 6 to about 11.

The desired stretching ratio can be achieved by stretching the yarn in one step or by repeatedly stretching the yarn.

The stretching can be conducted at any temperature but it is preferably conducted at a temperature above the glass transition temperature $T_g$ of the poly(acrylonitrile) and below the temperature at which the poly(acrylonitrile) is negatively effected, e.g., by oxidation and/or pyrolysis. Typically the stretching is conducted at a temperature above the glass transition temperature to about 100° C. to about 180° C., preferably in a range of above the glass transition temperature to about 140 ° C. to about 160° C.

The atmosphere during stretching is not particularly limited as long as the fibers are not detrimentally effected. It can be any usual atmosphere such as an inert atmosphere or air.

The diameter of the fibers which are obtained after step (iii) will vary depending on the chosen conditions. They can, for instance, be in the range of about 50 nm to about 1000 nm, preferably about 100 nm to about 500 nm.

The speed of stretching is not particularly limited. Stretching can be conducted at about 1 mm/s to about 100 mm/s, preferably about 5 mm/s to about 50 mm/s.

Step (iv): The Yarn Obtained in Step (ii) or (iii) is Annealed

The yarn which is obtained in step (ii) or (iii) can be further annealed in order to allow the poly(acrylonitrile) to react with the polyazide compound and thus form crosslinks between the poly(acrylonitrile) molecules. Annealing is usually conducted by heating the yarn in a temperature range of about 100° C. to about 160° C., preferably about 120° C. to about 140° C.

The duration of the annealing step will depend on the temperature and the desired extent of the reaction between the poly(acrylonitrile) and the polyazide. It can be, for instance, from about 0.1 h to about 6 h, preferably about 1 h to about 4 h.

Without wishing to be bound by theory it is assumed that the poly(acrylonitrile) and the polyazide compound react according to the "click" reaction (NPL-14) which is shown using a diazide compound as an example of a polyazide compound in the following:

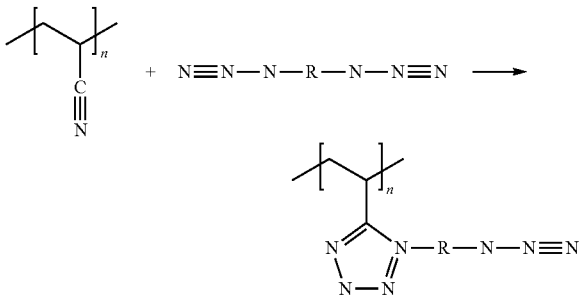

wherein n is the number of repeating units of acrylonitrile in the poly(acrylonitrile) and R is the residue of the polyazide compound. In the above scheme, one of the azide groups of the polyazide compound has reacted with one of the nitrile groups of the poly(acrylonitrile). The other azide group can react with another nitrile group or remain unreacted.

The yarn is typically under tension when the annealing is conducted in order to align the poly(acrylonitrile) molecules and thus further improve the mechanical properties. The tension of the yarn can be achieved by stretching the yarn and holding it in this stretched condition during the annealing or by wrapping it around a collector in a stretched condition before the annealing. The tension can vary depending on the desired end use and can be, e.g., from about 0 cN to about 50 cN, preferably about 5 cN to about 15 cN.

The diameter of the fibers which are obtained after step (iv) will vary depending on the chosen conditions. They can, for instance, be in the range of about 50 nm to about 1,000 nm, preferably about 100 nm to about 400 nm.

The atmosphere during annealing is not particularly limited. It can be any usual atmosphere such as an inert atmosphere or air.

Although it is not necessary to conduct stretching and annealing, the preferred method of the present invention is a method of preparing a poly(acrylonitrile) yarn comprising:

(i) providing a solution of poly(acrylonitrile) and a polyazide compound;

(ii) electrospinning the solution of poly(acrylonitrile) and a polyazide compound to provide fibers in the form of a yarn;

(iii) stretching the yarn obtained in step (ii); and (iv) annealing the stretched yarn.

The above explanations of steps (i) to (iv) apply to this preferred embodiment.

If the yarns are collected in the form of a nonwoven web they can also be stretched and annealed.

With the claimed method it is possible to provide yarns having a high toughness and tensile strength. Yarns having, for example, a toughness of about 100 J/g to about 200 J/g, preferably about 120 J/g to about 170 J/g, and a tensile strength of about 1.0 GPa to about 2.0 GPa, preferably about 1.1 GPa to about 1.5 GPa—values comparable to drag-line spider silk—can thus be obtained.

Without wishing to be bound by theory it is assumed that the high uniaxial orientation of the fibers and a cross-linking reaction between the poly(acrylonitrile) and the polyazide compound result in these outstanding properties.

Applications

Yarns

The yarns can be used in many different fields. Exemplary uses include artificial tendons, supports for weak blood vessels, artificial blood vessels, surgical threads, surgical sutures, wound covers, and sport textiles.

Nonwoven Web

The nonwoven webs can be used in many different fields. Exemplary uses include solar sails in aerospace, membranes, transformers, seat belts, and tear resistant light-weight outdoor equipment.

The present invention will be explained on the basis of the following examples which are not to be construed as limiting.

EXAMPLES

Materials

Poly(acrylonitrile) (PAN $M_n$ 120,000, Polymer dispersity index (PDI) 2.79, co-polymer with about 4.13 mol-% (6.35 wt.-%) methyl acrylate, Dolan)

Poly(ethylene glycol) bisazide (PEG-BA; $M_n$ 1,100; Sigma-Aldrich)

Dimethylformamide (DMF; Fisher Chemical, 99.99%) and acetone (technical grade) were used as received Yarn Electrospinning The solution (15 wt.-%) for electrospinning was prepared by dissolving 2 g poly(acrylonitrile) powder and 0.08 g poly(ethylene glycol) bisazide in 9.4 g dimethylformamide (DMF) solution and 1.93 g acetone. The continuous nanofiber yarns were fabricated using a homemade setup shown in FIG. 2 comprising two syringe pumps, a high-voltage DC power supply, a PVC funnel (8.0 cm in diameter) with a motor controller and a yarn winder collector having a diameter of 2 cm. The solution was loaded into two syringes capped with metal needles, respectively (controllable feed rate of 0.5 mL/h by two syringe pumps), which were connected separately to the positive and negative electrodes of the DC power supply.

After adjusting the angle (13 degree of inclination), distance (40 cm) and altitude (perpendicular distance to the plane of the end of funnel: 2 cm) of these two syringes, high voltages (positive pole: +12 kV; negative pole: −12 kV) were applied to two needle tips, respectively, resulting in positively and negatively charged continuous fibers. At first, by the force of electric field, these two oppositely charged fibers flew to the end of the funnel which rotated at 1,500 rpm and a fiber membrane was formed. The winder collector rotated at a speed of 13 rpm. The membrane was dragged up by a pre-suspended yarn which was connected with the winder collector. Then a rotodynamic fiber cone could be formed above the funnel. Simultaneously, heliciform fibers in the fiber cone were pulled up in a spiral path. Due to the cone maintained by the continuous heliciform fibers, a polymer yarn with continuous and twisted form was prepared from the apex of the fiber cone and winded around the collector 26. The whole electrospun yarn process was operated under an infrared lamp (250 VV) at about 45° C. and with 10% to 15% humidity.

Stretching and Annealing Process

To construct the continuously oriented hierarchical architecture, all as-spun multifiber yarns (unstretched and unannealed) were stretched at a high temperature using a homemade heat-stretching instrument as shown in FIG. 4. The apparatus consisting of three parts: a tubular furnace with one heat position zone (Heraeus, D6450 Hanau, Type: RE 1.1, 400 mm in length, Germany), two rollers controlled by electronic motors and a laptop with "LV2016" software, which was used to precisely control the velocities of the motors. By adjusting the velocities of the two rollers in the LV2016 software, the multifiber yarns could be stretched continuously. The stretch ratio (SR) was calculated by the equation: $SR=v_f/v_s$, where $v_f$ and $v_s$ represent the velocities of fast roller and slow roller, respectively. To obtain a high SR (greater than six), the multifiber yarns were stretched repeatedly.

The subsequent annealing process was achieved by wrapping the curable stretched multifiber yarns around a glass tube, keeping the multifiber yarns under a tension about 15 to 20 cN. The cycloaddition reaction between poly(acrylonitrile) and PEG-BA was achieved by the azide-nitrile "click" reaction at a suitably high temperature. After having been annealed at 130° C. for 4 h, the final multifiber yarns were obtained and quickly transferred to a refrigerator at −4° C. for 20 min.

Linear Density Tests

The linear density of multifiber yarns was measured by the weighing method, which was calculated by the formula:

$$D=W/L$$

where the D is the linear density (tex=g/km), W is the weight of the multifiber yarns and L is the length of the multifiber yarns. All the multifiber yarn samples were washed by ethanol for 24 h to move the residue solvent and then dried in vacuum oven at 40° C. for 24 h before measurement. The weight of dry multifiber yarns with a length of 30 cm was measured by an ultramicro balance (Sartorius MSE2.7S-000-DM Cubis, capacity of 2.1 g, readability of 0.0001 mg, Germany).

Mechanical Properties Tests

Tensile tests were performed using a tensile tester (zwickiLine Z0.5, BT1-FR0.5TN.D14, Zwick/Roell, Germany) with a clamping length of 10 mm, a crosshead rate of 5 mm/min at 25° C. and a pre-tension of 0.005 N. The load cell was a Zwick/Roell KAF TC with a nominal load of 200 N. The multifiber yarn samples were loaded between the two clamp stages with the top clamp stage applying uniaxial tension on the multifiber yarn samples along the vertical direction. The multifiber yarns tensile tests were performed by a test programme of yarn shape for cross-section calculation, while the linear density and density of the specimen material were input parameters. After the tensile test measurement, quantitative analysis of the modulus and toughness was carried out by Origin 8.0 software. The modulus was equal to the slope of the curves at 0 to 3% strain, and the toughness was calculated by the integral area of the tensile curves divided by density of the specimen material.

Scanning Electron Microscopy (SEM)

The morphology of all multifiber yarn samples was probed by a Zeiss LEO 1530 (Gemini, Germany) scanning electron microscope equipped with a field emission cathode and an SE2 detector. Before the measurements, for the surface SEM image measurements, all the multifiber yarn samples were attached to a sample holder with conductive double-side tape; for the cross-sectional SEM image measurements, all the multifiber yarn samples were obtained by cutting them in liquid nitrogen after they had been immersed in ethanol and water for 0.5 h. Subsequently, all the multifiber yarn samples were sputter-coated with 2.0 nm of platinum by a Cressington 208HR high-resolution sputter coater equipped with a quartz crystal microbalance thickness controller (MTM-20). A secondary electron (SE2) detector was used for acquiring SE2 images at an acceleration voltage of 3 kV and a working distance of 5.0 mm. The SEM images were used to study the diameter and morphology of the fibers and multifiber yarns. Quantitative analysis of the dimensional changes was carried out by ImageJ software. In addition, according to a previous literature report[19], the fiber alignment factors were calculated based on the following formula:

$$d_{F\alpha}=(3\cos^2\theta-1)/2$$

where $d_{F\alpha}$ is the fiber alignment factor and θ is the angle between the individual fibers and direction of the multifiber yarns. The given values were based on an average of 100 fibers.

The diameters of the fibers and of the multifiber yarns can also be determined by this SEM method.

Wide-Angle X-Ray Diffraction (WAXS)

WAXS characterization was carried out using an anode X-ray generator (Bruker D8 ADVANCE, Karlsruhe, Germany) operating at 40 kV and 40 mA with Cu-Kα radiation (wavelength λ=0.154 nm). Before the measurement, the multifiber yarns were aligned into a yarn bundle with a width of 3 mm in a paper frame, which was then fixed in the instrument stage. XRD profiles were recorded in the 2θ angle range from 8° to 36° at a scanning speed of 0.05°/min at 25° C. The acquired WAXS curves were analyzed by DIFFRAC.EVA V4.0 software, while the degree of crystallinity and the crystallite size ($L_{(100)}$) were calculated.

Measurement of Crystallinity Orientation

Crystalline orientation was determined from 2D X-ray scattering patterns of multifiber yarns aligned perpendicular to the X-ray with respect to their drawing direction. The scattering patterns were recorded with the SAXS system "Ganesha-Air" from (SAXSLAB/XENOCS). The X-Ray source of this laboratory-based system is a D2-MetalJet (Excillum) with a liquid metal anode operating at 70 kV and 3.57 mA with Ga-Kα radiation (wavelength λ=0.1314 nm) providing a very brilliant and a very small beam (<100 μm). The beam is slightly focused with a focal length of 55 cm using a specially made X-Ray optic (Xenocs) to provide a very small and intense beam at the sample position. Two pairs of scatterless slits are used to adjust the beam size depending on the detector distance. For the measurements the multifiber yarns were aligned into a small bundle consisting of three yarns and fixed on a small paper frame which was fixed on a metal frame sample holder with double sided scotch tape. The bundles were aligned perpendicular to the primary beam and horizontally with respect to the detector at a sample detector distance of 152 mm. For the heat stretching experiment a single as-spun fibre was mounted in a Linkam Tensile Testing Stage (TST350) were the glass windows were replaced with X-ray transparent mica windows. The stage was placed such that the fibre was aligned as the ones in the paper frame. The heating block of the stage was heated to 160° C. at a rate of 60°/min to keep the exposure to high temperature as small as possible. Upon reaching 160° C. the fibre was stretched at a rate of 1 mm/s to the desired stretching ratios. As soon as stretching was finished the SAXS measurement was started and the sample was cooled down to room temperature.

In all measurements, the scattering intensity was accumulated for 300 s. Background was always measured close to the respective sample position to minimize remnants of air scattering and shadows due to the sample holder and subtracted from the 2D image directly.

To determine the degree of orientation, first the subtracted 2D data were radially averaged to determine the radial peak width of the PAN (200) reflection. This width in q[$nm^{-1}$] was used to average the data azimuthally and obtain the I(φ)vs. φ plots. One of the two peaks was then fitted with a Lorenz-peak function using the built in routine of Origin 2018 to obtain the FWHM. This was used to calculate the degree of orientation using[20]:

$$S = \frac{180 - FWHM}{180}$$

Polarized Raman

For the polarized Raman measurements, a confocal WITec alpha 300 RA+imaging system equipped with a UHTS 300 spectrometer and a back-illuminated Andor Newton 970 EMCCD camera was used. Raman spectra were acquired using an excitation wavelength of λ=532 nm and an integration time of 0.2 s/pixel (100× objective, NA=0.9, step size of 100 nm for x,y-imaging, WITec Control FOUR 4.1 software). Before the measurements, a single multifiber yarn was stuck on a glass plate with a small amount of stress applied by double-sided tape to prevent vibration; the glass plate was perpendicular to the plane of light scattering. All the measurements focused on a single fiber in the multifiber yarns.

During the measurement, the power applied to the sample was filtered down to 5 mW. The polarizer was used to rotate the angle between the direction of the multifiber yarns and the direction of the linearly polarized light. By adjusting the angle, the polarization direction of incident light could be parallel or perpendicular to the scattering plane, which is the X or Y direction. Therefore, two Raman spectra were obtained, in the planes of XX and YY (XX and YY mean polarization parallel and perpendicular to the fiber axis, respectively.). According to previous literature reports[21,22], the molecular orientation factor (f) in the fibers was calculated by the following formula:

$$f = 1 - I_{YY}/I_{XX}$$

where $I_{XX}$ and $I_{YY}$ are the absorption intensity of the 2245 $cm^{-1}$ peak (—CN stretching vibration) in the XX and YY directions, respectively.

Number Average Molecular Weight $M_n$

The number average molecular weight can be determined using gel permeation chromatography (GPC), which was conducted in dimethyl formamide (DMF) as the eluent at a flow rate of 0.5 mL/min at room temperature, a pre-column PSS SDV (particle size 5 μm) and a column PSS SDV XL linear (particle size 5 μm) calibrated against polystyrene standards (PSS) using a PSS SECcurity RI detector. The GPC data were analyzed by the software PSS WinGPC Unity, Build 1321.

$^1$H-NMR Spectroscopy $^1$H-NMR spectroscopy was performed on a Bruker AMX-300 operating at 300 MHz. The deuterated dimethyl sulfoxide was used as the solvent. The specimens of about 10 mg were dissolved in 0.7 mL deuterated dimethyl sulfoxide then were transformed into the NMR tube for the measurement.

References Referred to in the Example Section:

1. Vollrath, F. & Knight, D. P. Liquid crystalline spinning of spider silk. *Nature* 410, 541-548 (2001).

2. Madsen, B., Shao, Z. Z. & Vollrath, F. Variability in the mechanical properties of spider silks on three levels: interspecific, intraspecific and intraindividual. *International journal of biological macromolecules* 24, 301-306 (1999).

3. Vollrath, F., Madsen, B. & Shao, Z. The effect of spinning conditions on the mechanics of a spider's dragline silk. *Proceedings of the Royal Society of London B: Biological Sciences* 268, 2339-2346 (2001).

4. Mei Zhang, Ken R. Atkinson & Baughman, R. H. Multifunctional Carbon Nanotube Yarns by Downsizing an Ancient Technology. *Science* 306, 1358-1361 (2004).

5. P. Miaudet et al. Hot-Drawing of Single and Multiwall Carbon Nanotube Fibers for High Toughness and Alignment. *Nano Lett.* 5, 2212-2215 (2005).

6. Motta, M., Moisala, A., Kinloch, I. A. & Windle, A. H. High Performance Fibres from 'Dog Bone' Carbon Nanotubes. *Adv. Mater.* 19, 3721-3726 (2007).

7. Shin, M. K. et al. Synergistic toughening of composite fibres by self-alignment of reduced graphene oxide and carbon nanotubes. *Nat Commun* 3, 650, doi:10.1038/ncomms1661 (2012).

8. Xu, Z., Sun, H., Zhao, X. & Gao, C. Ultrastrong fibers assembled from giant graphene oxide sheets. *Adv. Mater.* 25, 188-193 (2013).

9. Xiang, X. et al. In situ twisting for stabilizing and toughening conductive graphene yarns. *Nanoscale* 9, 11523-11529 (2017).

10. DuPont. *Technical Guide for Kevlar® Aramid Fiber.*

11. O'Connor, I., Hayden, H., Coleman, J. N. & Gun'ko, Y. K. High-strength, high-toughness composite fibers by swelling Kevlar in nanotube suspensions. *Small* 5, 466-469 (2009).

12. Dimitry Papkov et al. Simultaneously Strong and Tough Ultrafine Continuous Nanofibers. *ACS Nano* 7, 3324-3331 (2013).

13. Kim, S. H., Kim, H. & Kim, N. J. Brittle intermetallic compound makes ultrastrong low-density steel with large ductility. *Nature* 518, 77-79 (2015).

14. Dursun, T. & Soutis, C. Recent developments in advanced aircraft aluminium alloys. *Materials & Design* (1980-2015) 56, 862-871 (2014).

15. Ou, Y., Zhu, D. & Li, H. Strain Rate and Temperature Effects on the Dynamic Tensile Behaviors of Basalt Fiber Bundles and Reinforced Polymer Composite. *J. Mater. Civ. Eng.* 28, 04016101 (2016).

16. Wang, S. et al. Super-Strong, Super-Stiff Macrofibers with Aligned, Long Bacterial Cellulose Nanofibers. *Adv. Mater.*, doi:10.1002/adma.201702498 (2017).

17. Sui, X., Wiesel, E. & Wagner, H. D. Mechanical properties of electrospun PMMA micro-yarns: Effects of NaCl mediation and yarn twist. *Polymer* 53, 5037-5044 (2012).

18. Baniasadi, M. et al. High-performance coils and yarns of polymeric piezoelectric nanofibers. *ACS Appl Mater Interfaces* 7, 5358-5366 (2015).

19. R. Dersch, Taiqi Liu, A. K. Schaper, A. Greiner & Wendorff, J. H. Electrospun nanofibers: Internal structure and intrinsic orientation. *J. Polym. Sci., Part A* 41, 545-553 (2003).

20. Ouyang Q, Chen Y, Zhang N, Mo G, Li D, Yan Q. Effect of jet swell and jet stretch on the structure of wet-spun polyacrylonitrile fiber. *Macromol Sci Part B* 50, 2417-2427 (2011).

21. Mario J. Citra, D. Bruce Chase, Richard M. Ikeda & Gardner, K. H. Molecular orientation of high-density polyethylene fibers characterized by polarized Raman spectroscopy. *Macromolecules* 28, 4007-4012 (1995).

22. Wu, J., Mao, N., Xie, L., Xu, H. & Zhang, J. Identifying the crystalline orientation of black phosphorus using angle-resolved polarized Raman spectroscopy. *Angew. Chem. Int. Ed. Engl.* 54, 2366-2369 (2015).

Example 1

Multifiber yarns were prepared as described above in "yarn electrospinning" and "Stretching and annealing process".

Table 1 (FIG. 14) shows a comparison of mechanical properties of the thus prepared multifiber yarns with relevant literature values. The references are those referred to in the example section.

Example 2

Figure 6:
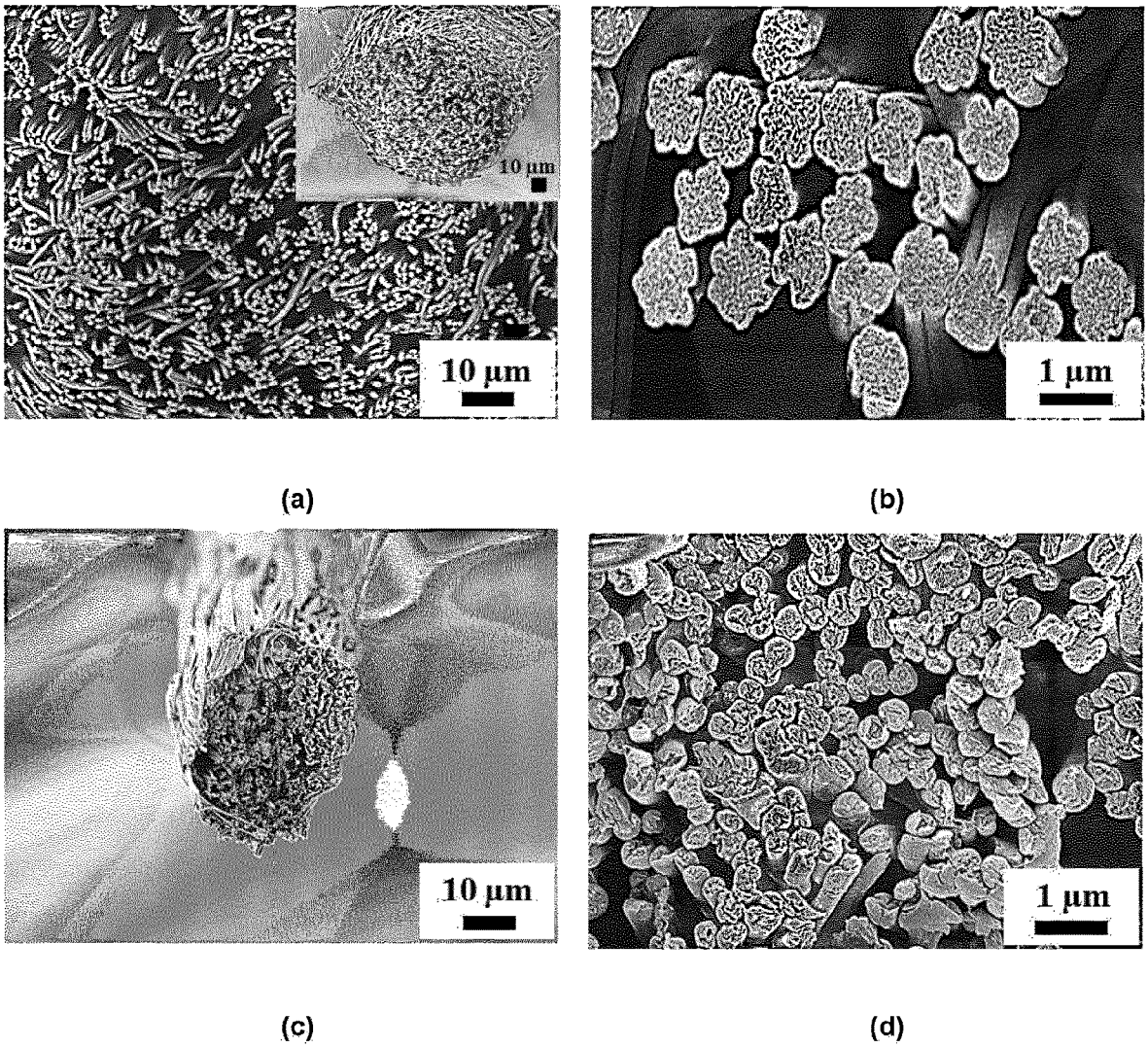
FIG. 6: Fibers of multifiber yarns:
- (a) and (b) cross-sectional SEM micrographs of as-spun multifiber yarns (without PEG-BA) at different magnifications. The inset in FIG. 6 (*a*) shows an image of as-spun multifiber yarns at low magnification.
- (c) and (d): Images of multifiber yarns (without PEG-BA) after stretching to a stretch ratio of 9 at 160° C. at different magnifications.
Figure 7:
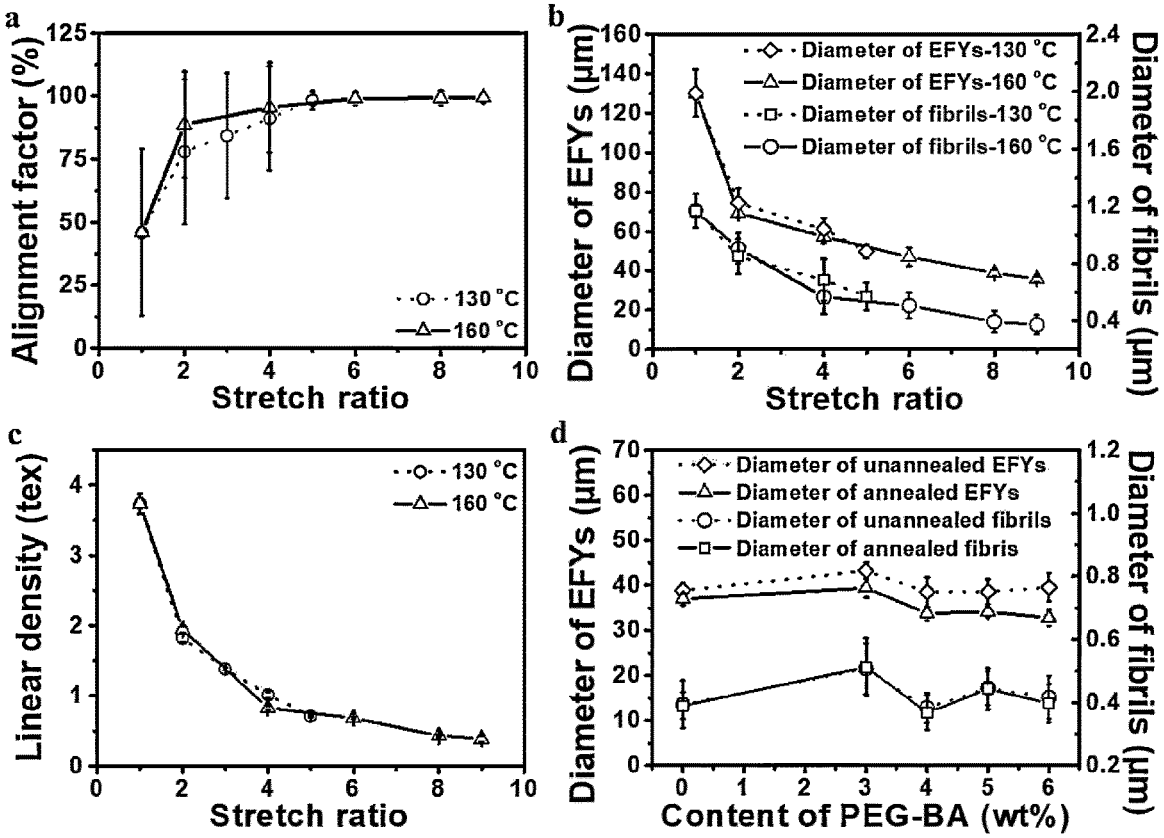
FIG. 7: Impact of stretching and annealing on the characteristics of the multifiber yarns:
- (a): Impact of stretching on the alignment factor of fibers in the multifiber yarns (without PEG-BA) at 130° C. and 160° C.
- (b): Impact of the stretch ratio on the diameter of multifiber yarns and fibers (without PEG-BA) at 160° C.
- (c): Impact of stretching on the linear density of multifiber yarns (without PEG-BA) at 130° C. and 160° C.
- (d): Effect of annealing at 130° C. for 4 hours on the diameter of stretched multifiber yarns (stretch ratio of 8 at 160° C.) with different contents of PEG-BA (EFY=multifiber yarn).
Figure 12:
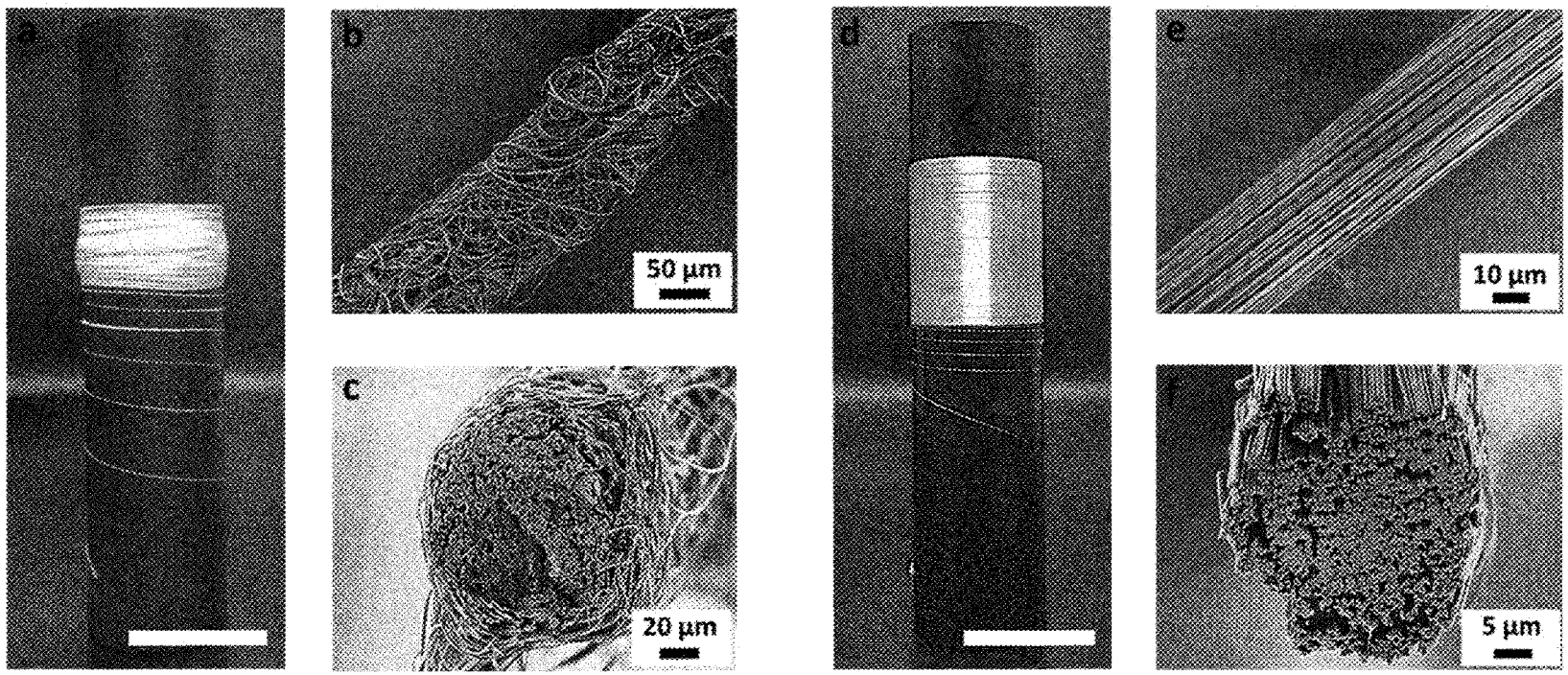
FIG. 12: Preparation of multifiber yams with 4 wt.-% PEG-BA.

In a model study with pure poly(acrylonitrile) (i.e., without PEG-BA), it was found that as-electrospun multifiber yarns had an average diameter of 130±12 μm and consisted of approximately 3000 non-oriented individual fibers (1.17±0.12 μm diameter; see also FIG. 12(*a*) to (*c*), FIG. 6(*a*) and (*b*) Heat stretching of multifiber yarns for several minutes resulted in manifold elongation of the yarn accompanied by its macroscopic appearance (FIG. 12(*d*)) and the alignment of the fibers in multifiber yarns (FIG. 12(*e*)). The stretching of multifiber yarns was conducted above the glass transition temperature ($T_g$) of the poly(acrylonitrile) ($T_g$=103° C.) but below its onset of oxidation at 180° C. (NPL-13). The alignment factor (orientation of the fibers of the yarn, values change from 0 for an isotropic orientation to 100% for a perfect alignment, details for calculation see above) increased from approximately 46.0% (as-spun multifiber yarns) to 99.6% (stretch temperature=160° C. at a stretch ratio of 9 (stretch ratio is the length of stretched yarn/length of as-spun yarn)) reaching convergence of the alignment factor at a stretch ratio of 6 for stretch temperature of 130° C. and 160° C., respectively (FIG. 7(*a*)). The stretching of multifiber yarns also caused a reduction of its diameter from 130±12 μm (unstretched multifiber yarns) to 50±3.3 μm (at a stretch ratio of 5 at 130° C.) and to 36±1.3 μm (at a stretch ratio of 9 at 160° C., FIGS. 6(*c*) and (*d*)), respectively. Simultaneously, the diameters of the fibers were reduced from 1.17±0.12 μm to 0.57±0.01 μm (130° C.) and 0.37±0.07 μm (160° C.), respectively (FIG. 12(*f*), FIG. 7(*b*)). The reduction of multifiber yarns in diameter by stretching can be explained by the untwisting and alignment of the fibers. Stretching also reduced the linear densities of the multifiber yarns, which changed from 3.74±0.14 tex (mass of fiber (g)/1000 m) in the as-spun multifiber yarns to 0.39±0.04 tex with a stretch ratio of 9 at 160° C. (FIG. 7(*c*)). After heat stretching, annealing of multifiber yarns under tension (about 10-15 cN) was conducted in order to achieve high toughness and high strength. This annealing (130° C. for 4 hrs in air) did not result in any further significant change of the diameters of multifiber yarns or the fibers (FIG. 7(*d*)).

Figure 8:
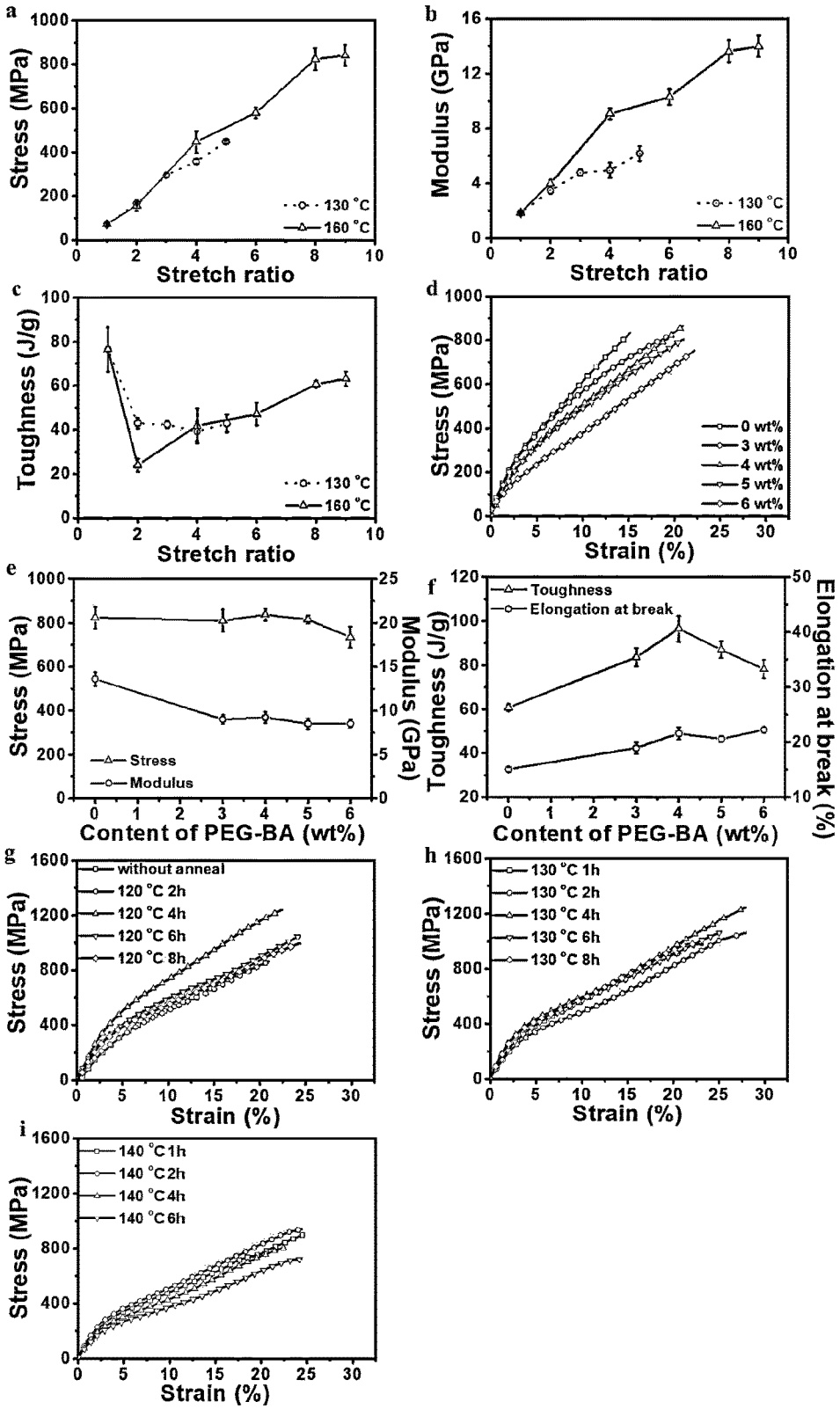
FIG. 8: Impact of processing parameters on the mechanical properties of multifiber yarns:
- (a) to (c): The changes of tensile strength (a), modulus (b) and toughness (c) of multifiber yarns with 0 wt.-% PEG-BA before annealing with different stretch ratios at different temperatures.
- (d): Stress/strain curves of multifiber yarns with different contents of PEG-BA before annealing with a stretch ratio of 8 at 160° C.
- (e) and (f): The changes of tensile strength, modulus (e), toughness and elongation at break (f) of multifiber yarns with different contents of PEG-BA before annealing with a stretch ratio of 8 at 160° C.
- (g) to (i): Stress/strain curves of multifiber yarns with 4 wt.-% PEG-BA and a stretch ratio of 8 at 160° C. annealed at 120° C. (g), 130° C. (h) and 140° C. (i) for different periods of time.

The results of the model study were transferred to multifiber yarns composed of poly(acrylonitrile) and PEG-BA. Azide group was reported to undergo the [2+3] click azide cycloaddition reaction (NPL-14) with the acrylonitrile groups of poly(acrylonitrile), which could favorably lead to bridging of the poly(acrylonitrile) macromolecules in the multifiber yarns. Different contents of PEG-BA in multifiber yarns from 0-4 wt.-% had no significant effect on the diameter of stretched and annealed multifiber yarns (FIG. 7(*d*)). In order to analyze the effect of PEG-BA in multifiber yarns on the mechanical properties, the toughness and the specific strength were analyzed for stretched and annealed multifiber yarns with different contents of PEG-BA. The maximum stress (FIG. 8(*a*)) and modulus (FIG. 8(*b*)) increased with the stretch ratio of multifiber yarns while the toughness did not linearly increase with the stretch ratio (FIG. 8(*c*)). The increase of PEG-BA content decreased the maximum stress and modulus slightly (FIGS. 8(*d*) and (*e*)) while the toughness increased slightly (FIG. 8(*f*)). In this example, the annealing time was found to be best for the maximum strength, the modulus and the toughness for 4 hrs while the best annealing temperature was 130° C. (FIGS. 8(*g*) to (*i*)). Taken together, these results show that the optimum values for tensile strength, modulus and toughness of the multifiber yarns were obtained with 4 wt.-% PEG-BA, a stretch ratio of 8 at 160° C. and subsequent annealing at 130° C. for 4 hours (FIG. 13).

Tensile test experiments revealed that for these optimal multifiber yarns, the tensile strength 1236±40.3 MPa, a modulus of 13.5±1.14 GPa, and a tensile toughness of 137±21.4 J/g that can mimic the properties of drag-line spider silk and a value for the tensile modulus of 13.5 GPa is close to the theoretical limit calculated for atactic crystalline poly(acrylonitrile) (NPL-15). The linear density of these optimal multifiber yarns was only 0.4±0.06 tex and had alignment factor of the fibers of 99.4%. A practical experiment involving the lifting of weights shows that the optimal multifiber yarns could lift a total mass of up to 30 g repeatedly without breaking. After repeatedly lifting 30 g, the multifiber yarns were slightly elongated (approximately 1 mm), which is possibly due to the elongation at the yielding point (strain of approximately 2.5%).

Figure 9:
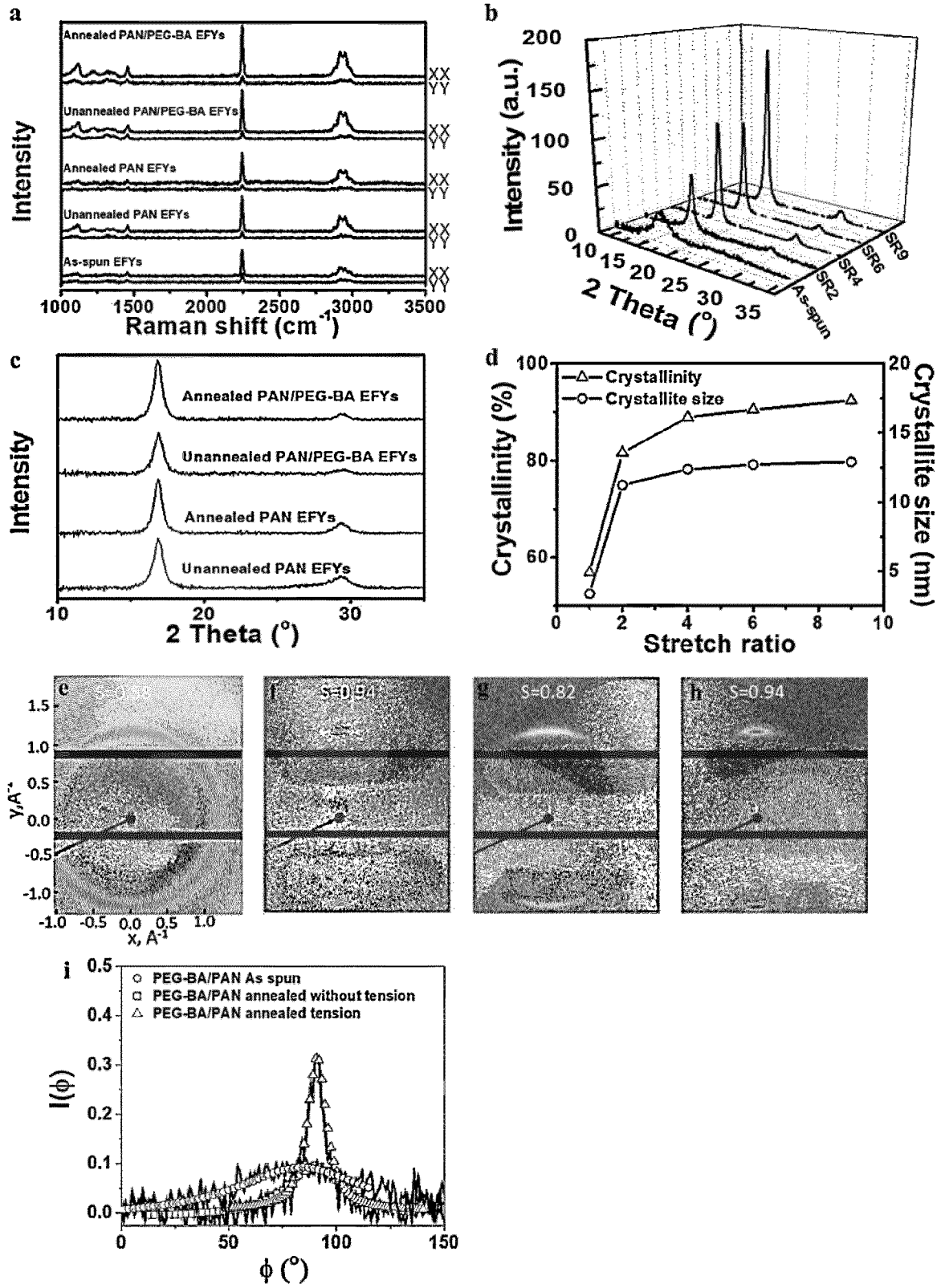
FIG. 9: Effect of annealing on multifiber yarns.
- (a): Polarized Raman spectra of as-spun multifiber yarns and unannealed and annealed (130° C., 4 h) multifiber yarns (stretch ratio of 8) with 0 wt.-% and 4 wt.-% PEG-BA. XX and YY mean polarization parallel and perpendicular to the fiber axis, respectively.
- (b): WAXS analysis of multifiber yarns with different stretch ratios (stretched at 160° C., 0 wt.-% PEG-BA; "SR2" in the figure is the logogram of a stretch ratio of 2).
- (c): WAXS analysis of multifiber yarns with 0 wt.-% and 4 wt.-% PEG-BA annealed at 130° C. for 4 h (stretch ratio of 8).
- (d): Dependence of the degree of crystallinity and crystallite size of multifiber yarns (without PEG-BA) (corresponding to FIG. 8(*b*)) as a function of the stretch ratio.
- (e) to (h): 2D scattering patterns of different multifiber yarns with 4 wt.-% PEG-BA.
  - (e): as spun multifiber yarns.
  - (f): stretched multifiber yarns.
  - (g): annealed multifiber yarns without tension.
  - (h): annealed multifiber yarns with tension.
- (i): representative I(ϕ)vs.ϕ plots. The bold lines are fits with a Lorentz peak function and from these the FWHM values were used to calculate the degree of crystal orientation.

The combination of high fiber orientation by stretching and annealing in the presence of PEG-BA yielded optimum high strength and toughness (FIGS. 13(*a*) and (*c*)). Polarized Raman spectroscopy confirmed that the heat stretching procedure oriented the poly(acrylonitrile) molecules along the multifiber yarns' main axis (FIG. 9(*a*)), with the percentage of aligned multifiber yarns increasing from 66.1% at stretch ratio 1 to 83.3% at stretch ratio of 8 (stretched at 160° C.). Wide-angle X-ray scattering experiments demonstrate that heat stretching resulted in a significant increase in the crystallinity of the multifiber yarns from approximately 56.9% (with a stretch ratio of 1) to approximately 92.4% (stretch ratio of 9, FIG. 9(*b*)) while annealing alone did not significantly increase crystallinity (FIG. 9(*c*)). FIG. 9 demonstrates that as-spun multifiber yarns have low orientational order with orientational order parameters in the range of S=0.37 to 0.58. Stretching considerably increases the orientational order, reaching very high values of S=0.96. Subsequent annealing should be performed under tension to maintain the high degree of orientational order of S=0.94 to 0.96. Without tension thermal motion reduces the degree of orientation to S=0.82 leading to the deterioration of the mechanical properties. Tensional forces during annealing seem to preserve the high degree of crystalline orientation, which is also strongly supported by in-situ X-ray diffraction measurements of the crystalline orientation during stretching at 160° C. (see FIG. 13*b*). Here the crystallinity orientation increased considerably from 0.37 to 0.96 by heat stretching but no significant increase was observed upon annealing (FIG. 13*b*, FIG. 9(*e*) to (*i*)). In fact, if no tensional forces are applied, the orientational order parameter drops from 0.96 to 0.82 during annealing due to thermal motion. The size of the crystallites increased considerably during stretching, from approximately 3.4 nm (stretch ratio of 1) to approximately 12.9 nm and matched the increase in crystallinity (stretch ratio of 9, FIG. 9(*d*)). From the structural data it is postulated that neither the crystallinity nor the crystallite size alone govern the outstanding mechanical properties.

Figure 10:
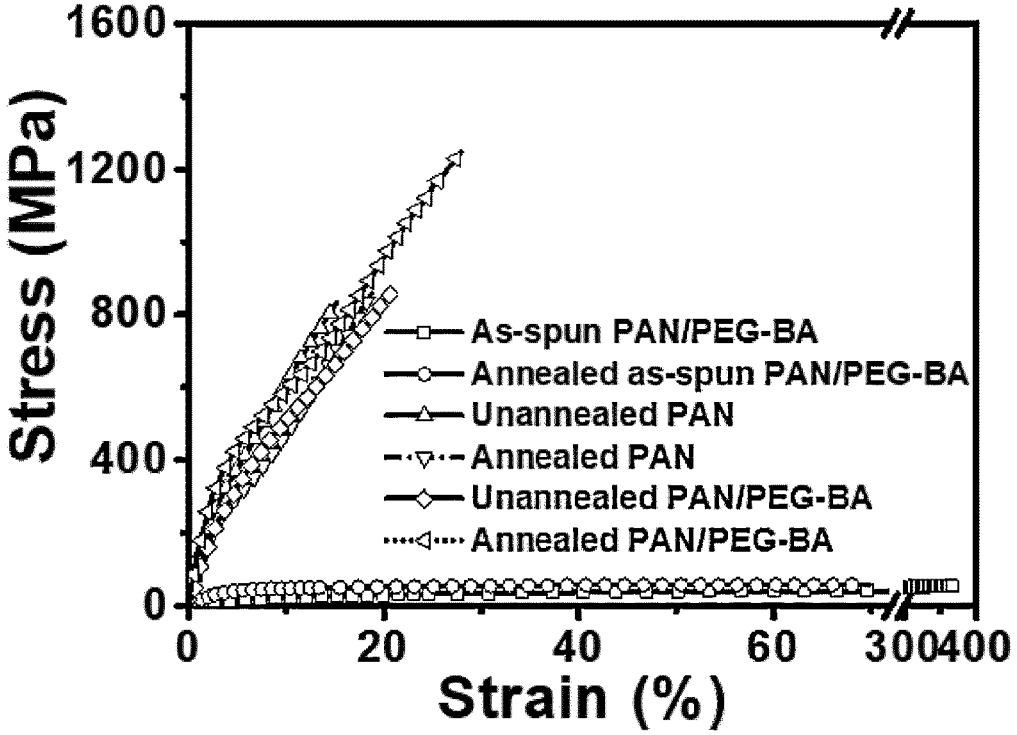
FIG. 10: Comparison of different multifiber yarns. Stress/strain curves of unannealed and annealed (130° C., 4 hours) multifiber yarns (stretch ratio of 8) with 0 wt.-% and 4 wt.-% PEG-BA, respectively.
Figure 11:
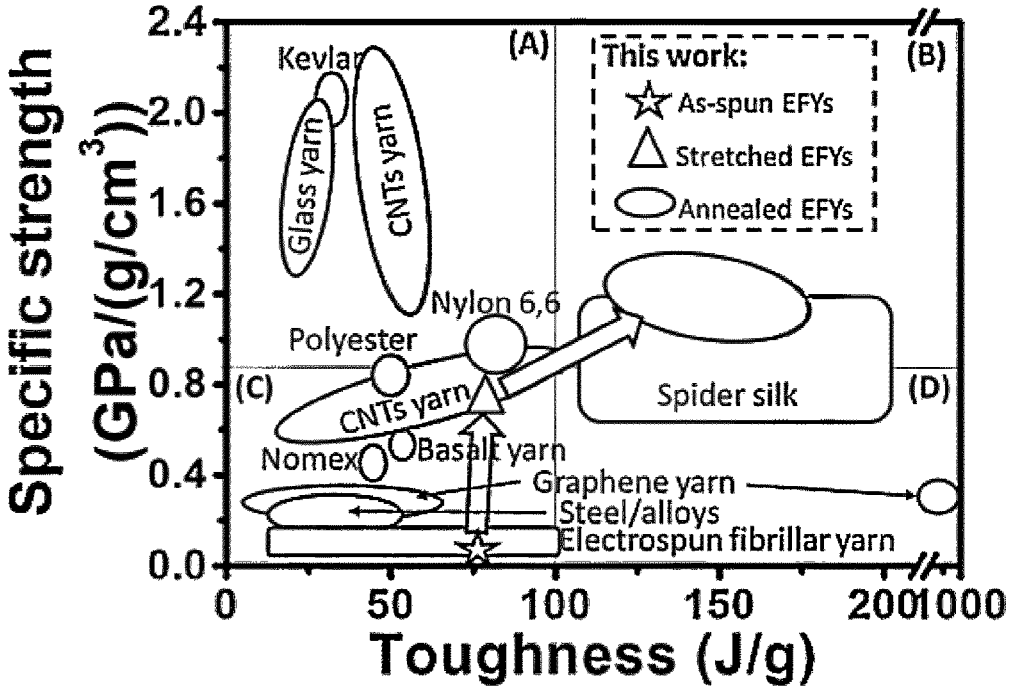
FIG. 11: Ashby plot of specific strength versus toughness for EFYs, spider silk, electrospun fibrillar yarn, and other materials. The data in the Ashby plot, which are shown in Table 1, are taken from the literatures.

The highly oriented ultrafine and cross-linked multifiber yarns of the present invention which contain many submicrometer fibers reached a specific strength and toughness that was comparable to drag-line spider silk before breaking (FIG. 13(*a*)). Both spider silk and multifiber yarns show lower specific strength than Kevlar but much higher toughness. Annealing was required to achieve the highest values for the toughness of multifiber yarns (FIG. 13(*c*)). It also obvious that simple annealing of multifiber yarns or stretching and annealing of multifiber yarns without PEG-BA does not yield the outstanding specific strength and toughness (FIG. 10). Overall, the toughness of multifiber yarns is higher than any other man-made yarns, and their specific strength is comparable (FIG. 11). FIG. 11 also shows the most significant development of specific strength and toughness of multifiber yarns throughout different steps of preparation of multifiber yarns, which are: as-spun (star in FIG. 11), stretched (triangle in FIG. 11), and finally annealed multifiber yarns (oval in FIG. 11). FIG. 11 shows that the strength of multifiber yarns increased by stretching but not the toughness, while the toughness increased by annealing (after stretching, which causes alignment of the fibers and crystallization of poly(acrylonitrile)) and to some extent also the strength increased.

The results also show also that too much cross-linking can reduce fiber resilience. Specifically, multifiber yarns with higher amounts of PEG-BA (in our study, 5 wt.-% and 6 wt.-%) showed lower strength and toughness than multifiber yarns with 4 wt.-% PEG-BA (FIGS. 8(*e*) and (*f*)). Furthermore, even without cross-linking, the multifiber yarns with the highest toughness and highest specific strength are still soluble in N,N'-dimethylformamide. This solubility indicates that complete cross-linking interconnection all poly (acrylonitrile) molecules in the fibers is neither required nor beneficial for the mechanical performance. We observe complete consumption of PEG-BA by gel permeation chromatography after annealing of multifiber yarns but no increase in molecular weight of poly(acrylonitrile). Therefore, we postulate that under the conditions for multifiber yarns interfiberlar reaction via PEG-BA is the dominating reaction.

Without wishing to be bound by theory, a possible model for understanding the unique mechanical properties of multifiber yarns with PEG-BA is shown in FIG. 13 (*a*). PEG-BA microphase in poly(acrylonitrile) separates to the fiber surface during crystallization of poly(acrylonitrile), where it is in the optimum location for efficient inter-fiber-crosslinking. Starting from pristine multifiber yarns, the poly(acrylonitrile) chains in the multifiber yarns start to disentangle resulting in a yield point. Beyond the yield point, the PEG-BA moieties bridging the poly(acrylonitrile) macromolecules relieve the stress, thereby restricting the movement of the poly(acrylonitrile) macromolecules, which leads to the increased toughness compared to the non-cross-linked case. At a critical stress, the PEG-BA bridges might rupture, causing multifiber yarns to break. This model is supported by the fact that higher cross-linking density the mechanical properties are reduced, quite similar to the dynamical rearrangement of crystallites in response to the applied stress in spider silk (NPL-4).

The invention claimed is:

1. A method of preparing poly(acrylonitrile) fibers comprising:

(i) providing a solution of poly(acrylonitrile) and a polyazide compound; and (ii) electrospinning the solution of poly(acrylonitrile) and a polyazide compound to provide fibers, wherein the polyazide compound is selected from the group consisting of poly(ethylene glycol) bisazide, poly(propylene glycol) bisazide, polyurethane bisazide and combinations thereof.

2. The method according to claim 1, wherein the fibers obtained in step (ii) are collected in the form of a yarn.

3. The method according to claim 2, wherein the yarn is stretched at a temperature which is above the glass transition temperature Tg of the poly(acrylonitrile) and is below the oxidation temperature of the poly(acrylonitrile).

4. The method according to claim 3, wherein the yarn is annealed.

5. The method according to claim 4, wherein the yarn is annealed at temperature in the range of about 120° C. to about 140° C.

6. The method according to claim 1, wherein the fibers obtained in step (ii) are collected in the form of a non-woven web.

7. Poly(acrylonitrile) fibers obtained by the method according to claim 1.

8. The poly(acrylonitrile) fibers according to claim 7 which are in the form of a nonwoven web or a yarn.

9. The poly(acrylonitrile) fibers according to claim 8 which are in the form of a yarn.

10. A method of preparing a poly(acrylonitrile) yarn comprising:

(i) providing a solution of poly(acrylonitrile) and a polyazide compound;

(ii) electrospinning the solution of poly(acrylonitrile) and a polyazide compound to provide fibers in the form of a yarn;

(iii) stretching the yarn obtained in step (ii); and (iv) annealing the stretched yarn, wherein the polyazide compound is selected from the group consisting of poly(ethylene glycol) bisazide, poly(propylene glycol) bisazide, polyurethane bisazide and combinations thereof.

11. A poly(acrylonitrile) yarn obtained by the method according to claim 10.

* * * * *